US006756193B2

(12) United States Patent
Katoh

(10) Patent No.: US 6,756,193 B2
(45) Date of Patent: Jun. 29, 2004

(54) HEAT-DEVELOPABLE IMAGE-RECORDING MATERIAL AND METHOD FOR FORMING IMAGE BY HEAT DEVELOPMENT USING SAME

(75) Inventor: Kazunobu Katoh, Kanagawa (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/767,952

(22) Filed: Jan. 24, 2001

(65) Prior Publication Data

US 2001/0038977 A1 Nov. 8, 2001

(30) Foreign Application Priority Data

Jan. 24, 2000 (JP) ..... 2000-017863
Mar. 17, 2000 (JP) ..... 2000-081782

(51) Int. Cl.[7] ..... G03C 1/498
(52) U.S. Cl. ..... 430/619; 264/598
(58) Field of Search ..... 430/619, 264, 430/349, 598, 620

(56) References Cited

U.S. PATENT DOCUMENTS 5,545,515 A * 8/1996 Murray et al. ..... 430/631
5,656,419 A * 8/1997 Toya et al. ..... 430/619
5,705,324 A * 1/1998 Murray ..... 430/619
6,027,871 A 2/2000 Katoh
6,060,228 A * 5/2000 Suzuki ..... 430/522
6,140,037 A 10/2000 Katoh et al.

FOREIGN PATENT DOCUMENTS

EP 0803764 * 10/1997 ..... G03C/1/498

* cited by examiner

*Primary Examiner*—Thorl Chea
(74) *Attorney, Agent, or Firm*—Birch, Stewart, Kolasch & Birch, LLP

(57) ABSTRACT

A heat-developable image-recording material comprising, on a support, a silver-supplying layer containing an organic silver salt, a reducing agent and an organic binder, and a separate photosensitive layer containing a photosensitive silver halide, the heat-developable image-recording material further containing an electron-transfer agent; and a method for forming an image by heat development comprising; imagewise exposing the heat-developable image-recording material and then heat-developing, whereby development of the photosensitive layer forms a silver image in the silver-supplying layer.

14 Claims, 2 Drawing Sheets

HEAT-DEVELOPABLE IMAGE-RECORDING MATERIAL AND METHOD FOR FORMING IMAGE BY HEAT DEVELOPMENT USING SAME

The present application claims priority under 35 USC 119 on Japanese patent applications No. 2000-017863, filed on Jan. 24, 2000, and No. 2000-081782, filed on Mar. 17, 2000, which are herein incorporated by reference.

BACKGROUND OF THE INVENTION

1. Field of the Invention

The present invention relates to an image-recording material, more particularly to an image-recording material having high sensitivity and high storage stability and also to a method for recording an image by heat development using a heat-developable image-recording material.

The present technique can be applied to various industrial fields including films for printing plates, films for ordinary photographs, films for microphotographs, films for medical use, etc. and to materials for recording images by means of a camera or by exposure to a scanning laser beam.

2. Description of the Related Art

A method for forming an image using a heat-developable image-recording material with an organic acid silver salt is described in, for example, U.S. Pat. Nos. 3,152,904 and 3,457,075 and D. Klosterboer 'Thermally Processed Silver Systems A' (imaging Processes and Materials) Neblette, 8th edition, Ed. by J. Sturge, V. Walworth and A. Shepp, Chapter 9, p. 279 (1989). These photosensitive materials contain a reducible non-photosensitive silver source (e.g. an organic silver salt), a catalytic amount of a photocatalyst (e.g. a silver halide) and a reducing agent for silver which are usually dispersed in an organic binder matrix. While these photosensitive materials are stable at normal temperature, silver is produced through a redox reaction between the reducible silver source (functioning as an oxidizing agent) and the reducing agent when heated to a high temperature (e.g. 80° C. or higher) after exposure. This redox reaction is promoted by the catalytic effect of the latent image formed by the exposure. The silver formed by the reaction of the reducible silver salt in the exposed area provides a black image, which contrasts with the non-exposed area, and an image is thus formed.

These photosensitive materials are generally formed by dispersing an organic silver salt and a silver halide, normally in a solution of an organic binder in an organic solvent, and adding a reducing agent dissolved in an organic solvent thereto. It is considered to be an essential requirement for the formation of an image that the silver halide is positioned so as to be in contact with the surface of the organic silver salt crystals. This is described in, for example, M. R. V. Sahyun, Thermally Developable Photographic Materials (TDPM): A Review of the State-of-the-Art in Mechanistic Understanding, J. Imaging Sci. Technology, 42, 23 (1998).

In recent years, heat-developable photosensitive materials containing an organic silver salt, a silver halide and a reducing agent using an aqueous dispersion of a thermoplastic polymer resin as a binder have been disclosed in JP-A-10-10669 and JP-A-10-10670. These image forming materials comprise a protective layer and a photosensitive layer in which an organic silver salt, a silver halide and a reducing agent are dispersed in a thermoplastic resin latex. In accordance with the above disclosure, a photosensitive silver halide is prepared beforehand, and the organic acid silver salt is crystallized in the presence of the silver halide grains. Although it is not specifically stated, it is surmised that the aim of the formation of the organic silver salt is to incorporate the silver halide crystals into the organic silver salt crystals so providing a state in which the organic silver salt and the silver halide are close to each other. This type of preparation method has been commonly employed among the above-mentioned systems using an organic solvent. Thus, the organic silver salt and the silver halide have been prepared so as to be close to each other, and they are inevitably coated in the same layer.

These heat-developable materials have an image formation layer of 10 μm to 30 μm, which is extremely thick in comparison with the ordinary wet process silver salt photographic materials, the photosensitive silver halide is thinly distributed among the organic acid silver salt grains, the exposure light path becomes long so increasing light scatter and absorption, and there is therefore the problem that the sensitivity and the resolution decrease. The photosensitive silver halide grains easily cause fogging in the presence of organic acid silver salt grains so resulting in the problem that the storage stability of the photosensitive material is degraded.

BRIEF SUMMARY OF THE INVENTION

An objective of the present invention is thus to provide a heat-developable image-recording material having high sensitivity and excellent storage stability. It is also an objective of the present invention to provide a method for forming an image using the above-mentioned recording material.

In accordance with the above and other objectives, a first aspect of the present invention relates to a heat-developable image-recording material comprising, on a support, a silver-supplying layer containing an organic silver salt, a reducing agent, an organic binder and substantially no photosensitive silver halide, and a separate photosensitive layer containing a photosensitive silver halide, the heat-developable image-recording material further containing an electron-transfer agent.

In the present invention "substantially no photosensitive silver halide" means such amount of photosensitive silver halide in the silver-supplying layer that has no influence to a formation of silver image in an interface between the silver-supplying layer and the photosensitive layer upon heat-developing after image-wise exposure. In the present invention the amount of photosensitive silver halide in a silver-supplying layer is, preferably 10 wt % or less, and more preferably 1 wt % or less, of a coated amount of photosensitive silver halide in a photosensitive layer of the heat-developable image-recording material. Most preferably, the silver-supplying layer of the present invention contain no photosensitive silver halide.

Although in the art the organic silver salt cannot be heat-developed unless the organic silver salt grains and silver halide grains are close to each other, the present inventor has found that, even when the two are present in separate layers, the use of the electron-transfer agent described in the present invention allows an image to be formed in the silver-supplying layer by exposure and development of the photosensitive layer.

A second aspect of the present invention relates to a method for forming an image by heat development comprising imagewise exposing a heat-developable image-recording material comprising, on a support, at least one silver-supplying layer containing an organic silver salt, a reducing agent, and an organic binder, and a separate photosensitive layer containing a photosensitive silver halide, the heat-developable image-recording material further containing an electron-transfer agent, and then heat-developing the heat-developable image-recording material, whereby development of the photosensitive layer forms a silver image in the silver-supplying layer.

The silver-supplying layer preferably contains no photosensitive silver halide. The silver-supplying layer preferably contains a halogen precursor. The photosensitive layer preferably contains a reducing agent. The organic binder is preferably formed from a polymer latex dispersed in an aqueous medium. The reducing agent is preferably used in the form of solid microparticles dispersed in an aqueous medium. The halogen precursor is preferably used in the form of solid microparticles dispersed in an aqueous medium. The electron transfer agent is selected from hydrazine derivatives, alkene derivatives, isoxazole derivatives and acetal compounds.

In accordance with the present invention, a heat-developable image-recording material having high sensitivity and excellent storage stability can be obtained.

BRIEF DESCRIPTION OF THE SEVERAL VIEWS OF THE DRAWINGS

In FIG. 1 a protective layer (1), a photosensitive layer (2), and a silver-supplying layer (3) were observed. In FIG. 2 a protective layer (1A), a photosensitive layer (2A), a silver-supplying layer (3A) in which a silver layer image is formed, and undeveloped silver supplying layer were observed. In FIG. 3 a protective layer (1) and a photosensitive organic acid silver salt layer were observed.

DETAILED DESCRIPTION OF THE INVENTION

Figure 1:
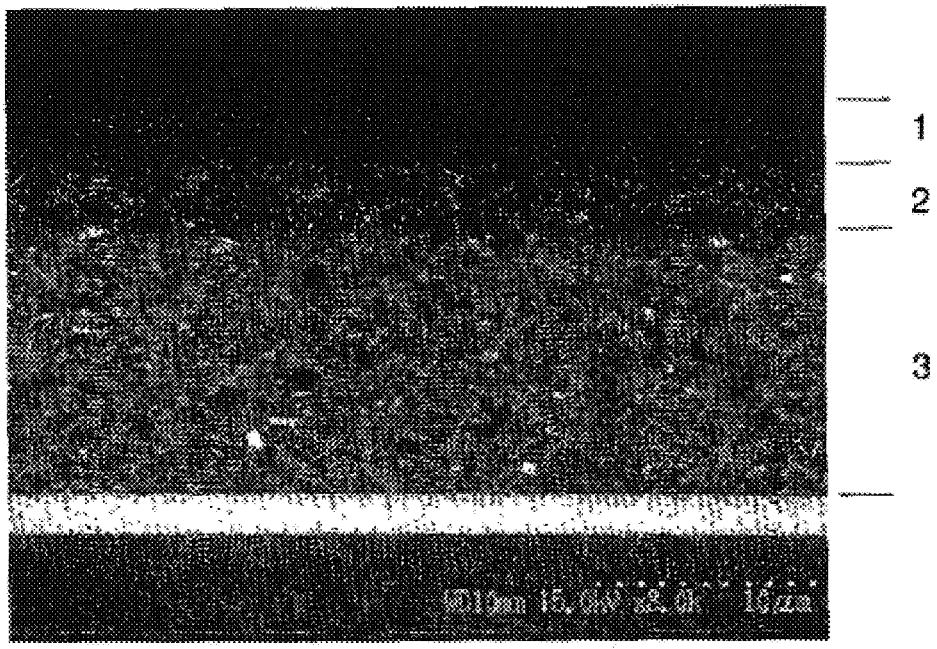
FIG. 1 is a scanning electron micrograph of a cross section of a heat-developable image-recording material related to one embodiment of the present invention before heat development at a magnification of 3000 times.

The present invention is explained in detail below.

The method for forming an image by heat development of the present invention is characterized in that a silver image is formed in a silver supplying layer by imagewise exposing a heat-developable image-recording material comprising, on a support, a silver-supplying layer containing an organic silver salt, a reducing agent, and an organic binder and a separate photosensitive layer containing a photosensitive silver halide, the heat-developable image-recording material further containing an electron-transfer agent, and then heat developing it.

In accordance with the above-mentioned method, an image having excellent quality can be formed.

The organic silver salt used in the present invention is a silver salt which is relatively stable toward exposure to light but can produce a silver image when heated at 80° C. or higher in the presence of a light-exposed photocatalyst (e.g. a latent image of photosensitive silver halide) and a reducing agent. The organic silver salt may be any organic substance containing a silver ion source that can be reduced. The silver salt of an organic acid and, in particular, the silver salt of a long-chain aliphatic carboxylic acid (with 10 to 30, and preferably 15 to 28 carbon atoms) is preferred. An organic or inorganic silver salt complex, whose ligand has a complex stability constant of from 4.0 to 10.0, is also preferred. The silver-supplying substance may preferably constitute approximately 5 to 70 wt % of the image-forming layer. Preferable organic silver salts include the silver salts of organic compounds having a carboxyl group. Examples thereof include the silver salts of aliphatic carboxylic acids and aromatic carboxylic acids, while not being limited thereto. Preferred examples of the silver salts of aliphatic carboxylic acids include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and mixtures thereof.

The silver salts of compounds having a mercapto or thione group and derivatives thereof may also be used as the organic silver salt. Preferred examples of these compounds include the silver salt of 3-mercapto-4-phenyl-1,2,4-triazole; the silver salt of 2-mercaptobenzimidazole; the silver salt of 2-mercapto-5-aminothiadiazole; the silver salt of 2-(ethylglycolamido)benzothiazole; the silver salts of thioglycolic acids such as the silver salts of S-alkylthioglycolic acids (whose alkyl groups have 12 to 22 carbon atoms); the silver salts of dithiocarboxylic acids such as the silver salt of dithioacetic acid; the silver salts of thioamides; the silver salt of 5-carboxyl-1-methyl-2-phenyl-4-thiopyridine; the silver salt of mercaptotriazine; the silver salt of 2-mercaptobenzoxazole; the silver salts of 1,2,4-mercaptotriazole derivatives such as the silver salt of 3-amino-5-benzylthio-1,2,4-triazole as described in U.S. Pat. No. 4,123,274; and the silver salts of thione compounds such as the silver salt of 3-(3-carboxyethyl)-4-methyl-4-thiazoline-2-thione as described in U.S. Pat. No. 3,301,678. Imino-containing compounds may also be used. Preferred examples of these compounds include the silver salt of benzotriazole and derivatives thereof, for example, the silver salts of benzotriazoles such as the silver salt of methylbenzotriazole; the silver salts of halogenated benzotriazoles such as the silver salt of 5-chlorobenzotriazole; the silver salts of 1,2,4-triazole and 1H-tetrazole, and the silver salts of imidazole and imidazole derivatives as described in U.S. Pat. No. 4,220,709. Also useful are various silver acetylide compounds as described, for example, in U.S. Pat. Nos. 4,761,361 and 4,775,613.

The shape of the organic silver salt which can be used in the present invention is not particularly limited and various shapes including acicular, platelet and clump shapes can be used. Acicular and platelet-shaped crystal forms are particularly preferred. In the case of acicular crystals, the short axis is preferably from 0.01 to 0.20 $\mu$m, more preferably from 0.01 to 0.15 $\mu$m, and the long axis is preferably from 0.10 to 5.0 $\mu$m, more preferably from 0.10 to 4.0 $\mu$m. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, and still more preferably 50% or less. The shape of the organic silver salt can be determined based on the image of the organic silver salt dispersion observed with a transmission type electron microscope. Another method for determining the monodispersibility is by obtaining the standard deviation of the volume-averaged mean diameter of the organic silver salt. The percentage (coefficient of variation) of the value obtained by dividing the standard deviation by the volume-averaged mean diameter is preferably 100% or less, more preferably 80% or less, and still more preferably 50% or less. The measurement procedure includes irradiating the organic silver salt dispersed in a solution with laser light, deriving an autocorrelation function with respect to the time-dependent fluctuation in the scattered light, and thereby obtaining the grain size (volume-averaged mean diameter).

The organic silver salt used in the present invention is preferably desalted. The desalting method is not particularly limited and known methods may be used. Known filtration methods such as centrifugal filtration, suction filtration, ultrafiltration and flocculation washing based on coagulation may be preferably used.

To obtain a solid dispersion of the organic silver salt with a high S/N ratio, small grain size and no coagulation, it is preferable in the present invention to employ a dispersion method in which an aqueous dispersion, containing the organic silver salt as an image-forming medium and containing substantially no photosensitive silver salt, is made to flow at high speed and then subjected to a pressure drop.

After such a process, the aqueous dispersion is mixed with an aqueous photosensitive silver salt solution to produce a coating liquid for a photosensitive image-forming medium. Using such a coating liquid ensures a heat-developable photosensitive material with low haze, low fog and high sensitivity. On the other hand, the presence of a photosensitive silver salt at the time of dispersion by conversion into a high-pressure, high-speed flow will result in increased fog and significantly lowered sensitivity. Using an organic solvent in place of water also tends to raise the haze, increase the fog and lower the sensitivity. Employing a conversion method in which a proportion of the organic silver salt in the dispersion is converted into a photosensitive silver salt may lower the sensitivity. The aqueous dispersion obtained after conversion into a high-pressure, high-speed flow contains substantially no photosensitive silver salt, has a water content of 0.1 mol % or less relative to the non-photosensitive organic silver salt, and is not subjected to the intentional addition of a photosensitive silver salt.

Solid dispersion apparatus and technologies for implementing the above dispersion method are detailed, for example, in "Bunsankei Rheology to Bunsanka Gijutsu (Disperse System Rheology and Dispersion Technology)", by Toshio Kajiuchi and Hiroki Usui, 1991, issued by Shinzansha Shuppann, p.357–403; and "Kagaku Kogaku no Shinpo (Advances in Chemical Engineering) Vol. 24", ed. Tokai Section, The Society of Chemical Engineers, 1990, issued by Maki Shoten, p.184–185. According to the dispersion method employed in the present invention, the aqueous dispersion containing at least an organic silver salt is fed through a pipe while being pressurized with a high-pressure pump, then allowed to pass through a narrow slit, which causes the aqueous dispersion to experience an abrupt pressure drop and thereby enables a fine dispersion to be obtained.

As for a high-pressure homogenizer suitable for use in the present invention, dispersion into fine particles is generally considered to be effected by dispersion forces such as (a) the "shearing force" generated when a dispersoid passes through a narrow gap under high pressure and at high speed, and (b) the "cavitation force", generated when the high pressure exerted on the dispersoid is released and it returns to normal pressure. The Gaulin homogenizer has long been known as such a dispersion apparatus, in which a pressure-fed process solution is converted into a high-speed flow at a narrow gap on a cylinder surface, and then collides at high speed with the peripheral wall, thereby allowing emulsification or dispersion to be assisted by the impact force. The operating pressure is, in general, selected from a range of 100 to 600 kg/cm$^2$, and the flow rate from several to 30 m/second. Equipment has also been proposed such as that having a proportion at a high flow rate in the form of sawtooth so as to increase the collision frequency in order to increase the dispersion efficiency. In recent years, equipment has also been developed that allows dispersion at higher pressures and faster flow rates, typified by the Microfluidizer (Microfluidex International Corporation) and the Nanomizer (Tokushu Kika Kogyo Co., Ltd.).

Dispersion equipment appropriate to the present invention includes the Microfluidizer M-110S-EH (with G10Z interaction chamber), M-110Y (with H10Z interaction chamber), M-140K (with G10Z interaction chamber), HC-5000 (with L30Z or H230Z interaction chamber) and HC-8000 (with E230Z or L30Z interaction chamber), all of which are manufactured by Microfluidex International Corporation.

Using such apparatus, an aqueous dispersion containing at least an organic silver salt is fed to a pipe while being pressurized with a high-pressure pump, etc., the dispersion is then passed through a narrow slit provided in the pipe so as to apply the desired pressure, and then the pressure within the pipe is quickly released and returns to atmospheric pressure thereby causing an abrupt pressure drop in the dispersion. An optimum organic silver salt dispersion for the present invention can thus be obtained.

In the present invention, it is possible to disperse the organic silver salt so as to attain a desired grain size by appropriately adjusting the flow rate, pressure difference at the time of the pressure drop and the number of repetitions of the process. Taking the photographic properties and the grain size into consideration, the flow rate is preferably from 200 to 600 m/sec, and more preferably from 300 to 600 m/sec, and the pressure difference at the pressure drop is preferably from 900 to 3000 kg/cm$^2$, and more preferably from 1500 to 3000 kg/cm$^2$. The number of repetitions of the process is selectable as required. While it is generally selected to be from once to as many as 10 times, once to as many as 3 times is preferred from the viewpoint of productivity. Raising the temperature of such an aqueous dispersion under high pressure is undesirable from the viewpoint of dispersibility and photographic properties, that is, raising the temperature above 90° C. tends to result in increased grain size and increased fogging. It is thus preferable in the present invention to provide a cooling step before the conversion into the high-pressure, high-speed flow and/or after the pressure drop so as to maintain the temperature of the aqueous dispersion within a range from 5 to 90° C., more preferably from 5 to 80° C., and still more preferably 5 to 65° C. Providing such a cooling step is exceptionally effective when the dispersion is carried out under a pressure as high as 1500 to 3000 kg/cm$^2$. A cooler is appropriately selected, depending on the required heat exchange capacity, from those equipped with a double pipe or a double pipe combined with a static mixer; a shell-and-tube heat exchanger; and a coiled heat exchanger. The diameter, wall thickness and material of the pipe are appropriately selected, taking into consideration the operating pressure, so as to improve the efficiency of the heat exchange. Coolants available for the cooler include well water at 20° C.; cold water at 5 to 10° C. fed from a chiller; and, as required, ethylene glycol/water at −30° C.

In the dispersion process of the present invention, the organic silver salt is preferably dispersed in the presence of a dispersant (dispersion aid) soluble in an aqueous solvent. The dispersant can be suitably selected from, for example, synthetic anionic polymers such as polyacrylic acid, copolymers of acrylic acid, maleic acid copolymers, maleic acid monoester copolymers and acryloylmethylpropanesulfonic acid copolymers; semisynthetic anionic polymers such as carboxymethylated starch and carboxymethylcellulose; anionic polymers such as alginic acid and pectic acid; compounds disclosed in JP-A-7-350753; known anionic, nonionic and cationic surfactants; other known polymers such as polyvinyl alcohol, polyvinylpyrrolidone, carboxymethyl cellulose, hydroxypropyl cellulose, and hydroxypropylmethyl cellulose; and naturally occurring polymers such as gelatin and the like. Most preferable are polyvinyl alcohols and water-soluble cellulose derivatives.

The dispersant is generally mixed with the organic silver salt in the form of a powder or wet cake before the dispersing operation, and fed as a slurry into a dispersion apparatus, but the dispersant may also be included in the powder or wet cake by heat treatment or solvent treatment of a premixture of the dispersant with the organic silver salt. The pH may be controlled with a suitable pH adjusting agent during or after the dispersing operation.

Besides such a mechanical dispersing operation, the organic silver salt may be roughly dispersed into a solvent by pH control and then made into microparticles by altering the pH in the presence of a dispersant. The solvent for the rough dispersion may be an organic solvent which is generally removed after making the microparticles.

The dispersion so produced can be stored with stirring in order to prevent precipitation of the microparticles during storage, or stored in a highly viscous state by producing a hydrophilic colloid (e.g. a gelatinous state formed by gelatin). Further, a preservative may be added in order to prevent bacterial growth during storage.

In the present invention, a desired amount of silver salt can be used and is preferably 0.1 to 5.0 g/m$^2$ expressed as the silver content, and more preferably 0.3 to 2.5 g/m$^2$.

The electron-transfer agent used in the present invention is now explained. The electron-transfer agent used in the present invention is converted into an active form by reaction with the reaction product obtained by development of the photosensitive layer and the silver-supplying layer is thus made developable. With regard to electron-transfer agents which are useful for the present invention, there are hydrazine derivatives, alkene derivatives, isoxazole derivatives and acetal compounds.

With regard to the hydrazine derivatives, compounds represented by formula (1) below are preferred.

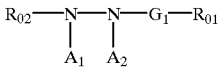

(1)

In the formula, $R_{0\ 2}$ denotes an aliphatic or aromatic group, $R_{0\ 1}$ denotes hydrogen, alkyl, aryl, unsaturated heterocyclic, alkoxy, aryloxy, amino or hydrazino, $G_1$ denotes —CO—, —$SO_2$—, —SO—, —P(O)—, —$R_{0\ 3}$P(O)—, —COCO—, thiocarbonyl or iminomethylene, and $A_1$ and $A_2$ independently denote hydrogen or substituted or unsubstituted alkyl sulfonyl. $R_{0\ 3}$ is chosen from the group defined for $R_{0\ 1}$, and may be different from $R_{0\ 1}$.

The aliphatic group denoted by $R_{0\ 2}$ in general formula (1) is preferably a substituted or unsubstituted, straight-chain, branched-chain or cyclic alkyl, alkenyl or alkynyl group having 1 to 30 carbon atoms. The aromatic group denoted by $R_{0\ 2}$ is a monocyclic or fused-ring aryl group and, for example, benzene and naphthalene can be cited. The heterocycles denoted by $R_{0\ 2}$ are monocyclic or fused-ring, saturated or unsaturated, and aromatic or non-aromatic heterocycles. There can be cited as examples pyridine, pyrimidine, imidazole, pyrazole, quinoline, isoquinoline, benzimidazole, thiazole, benzothiazole, piperidine, triazine, morpholine, piperazine, etc. $R_{0\ 2}$ may be substituted with any substituent.

$R_{0\ 2}$ is preferably aryl, alkyl or an aromatic heterocycle, and more preferably substituted or unsubstituted phenyl, substituted alkyl having 1 to 3 carbon atoms or an aromatic heterocycle.

Among the substituted alkyl groups having 1 to 3 carbon atoms denoted by $R_{0\ 2}$, substituted methyl is preferred, and di- or tri-substituted methyl is more preferred. With regard to preferred detailed examples of the substituted methyl group denoted by $R_{0\ 2}$, t-butyl, dicyanomethyl, dicyanophenylmethyl, triphenyl methyl (trityl), diphenylmethyl, methoxycarbonyidiphenylmethyl, cyanodiphenylmethyl, methylthiodiphenylmethyl, cyclopropyl di phenyl methyl, etc. can be cited, and trityl is the most preferred. Among the aromatic heterocycles denoted by $R_{0\ 2}$, the preferred heterocycles include pyridine, quinoline, pyrimidine, triazine, benzothiazole, benzimidazole, thiophene, etc. In general formula (1), $R_{0\ 2}$ is most preferably substituted or unsubstituted phenyl.

In general formula (1), $R_{0\ 1}$ denotes hydrogen or a blocking group. In detail, the blocking group denotes an aliphatic group (in detail, alkyl, alkenyl, alkynyl), an aromatic group (monocyclic or fused-ring aryl), a heterocycle, alkoxy, aryloxy, substituted or unsubstituted amino or hydrazino.

$R_{0\ 1}$ is preferably alkyl (substituted or unsubstituted alkyl having 1 to 10 carbon atoms, e.g. methyl, ethyl, trifluoromethyl, difluoromethyl, 2-carboxytetrafluoroethyl, pyridiniomethyl, difluoromethoxymethyl, difluorocarboxymethyl, hydroxymethyl, benzenesulfonamidomethyl, trifluoroacetylmethyl, dimethylaminomethyl, phenylsulfonylmethyl, o-hydroxybenzyl, methoxymethyl, phenoxymethyl, 4-ethylphenoxymethyl, phenylthiomethyl, t-butyl, dicyanomethyl, diphenylmethyl, triphenylmethyl, methoxycarbonyldiphenylmethyl, cyanodiphenylmethyl, methylthiodiphenylmethyl, etc.), alkenyl (alkenyl having 1 to 10 carbon atoms, e.g. vinyl, 2-ethoxycarbonylvinyl, 2-trifluoro-2-methoxycarbonylvinyl, 2,2-dicyanovinyl, 2-cyano-2-methoxycarbonylvinyl, etc.), aryl (monocyclic or fused-ring aryl, those containing a benzene ring are particularly preferred, e.g. phenyl, perfluorophenyl, 3,5-dichlorophenyl, 2-methanesulfonamidophenyl, 2-carbamoylphenyl, 4,5-dicyanophenyl, 2-hydroxymethylphenyl, 2,6-dichloro-4-cyanophenyl, 2-chloro-5-octylsulfamoylphenyl), heterocyclic (five to six membered saturated or unsaturated, monocyclic or fused-ring heterocycle containing at least one atom chosen from nitrogen, oxygen and sulfur, e.g. morpholino, piperidino (N-substituted), imidazolyl, indazolyl, pyrazolyl, triazolyl, benzimidazolyl, tetrazolyl, pyridyl, pyridinio, quinolinio, quinolyl, hydantoyl, imidazolidinyl, etc.), alkoxy (alkoxy having 1 to 8 carbon atoms is preferred, e.g. methoxy, 2-hydroxyethoxy, benzyloxy, t-butoxy, etc.), or amino (unsubstituted amino, alkylamino having 1 to 10 carbon atoms, arylamino, or saturated or unsaturated heterocyclic amino (including nitrogen-containing heterocyclic amino containing quaternary nitrogen) are preferred, e.g. 2,2,6,6-tetramethylpiperidin-4-ylamino, propylamino, 2-hydroxyethylamino, anilino, o-hydroxyanilino, 5-benzotriazolylamino, N-benzyl-3-pyridinioamino, etc.). The group denoted by $R_{01}$ may be substituted with any substituent.

In the case where $R_{02}$ denotes phenyl or an aromatic heterocycle and $G_1$ is —CO—, $R_{01}$ is preferably hydrogen, alkyl, alkenyl, alkynyl, aryl or heterocyclic, more preferably hydrogen, alkyl, aryl, and most preferably hydrogen or alkyl. When $R_{01}$ denotes alkyl, with regard to substituents thereof, halogen, alkoxy, aryloxy, alkylthio, arylthio, hydroxy, sulfonamido, amino, acylamino and carboxyl are particularly preferred. In the case where $R_{02}$ denotes substituted methyl and $G_1$ is —CO—, $R_{01}$ is preferably hydrogen, alkyl, aryl, heterocyclic, alkoxy or amino (unsubstituted amino, alkylamino, arylamino, heterocyclic amino), and more preferably hydrogen, alkyl, aryl, heterocyclic, alkoxy, alkylamino, arylamino or heterocyclic amino. When $G_1$ is —COCO—, regardless of the nature of $R_{02}$, $R_{01}$ is preferably alkoxy, aryloxy or amino, particularly preferably substituted amino and, in detail, alkylamino, arylamino or saturated or unsaturated heterocyclic amino. When $G_1$ is —$SO_2$—, regardless of the nature of $R_{02}$, $R_{01}$ is preferably alkyl, aryl or substituted amino.

In general formula (1), $G_1$ is preferably —CO— or —COCO—, and particularly preferably —CO—.

In general formula (1), $A_1$ and $A_2$ independently denote hydrogen, alkyl- or aryl-sulfonyl having 20 or fewer carbon atoms (preferably phenylsulfonyl or substituted phenylsulfonyl where the sum of the Hammett constants of the substituents is −0.5 or higher), acyl having 20 or less carbon atoms (preferably benzoyl or substituted benzoyl where the sum of the Hammett constants of the substituents is −0.5 or higher, or straight chain, branched chain or cyclic substituted or unsubstituted aliphatic acyl). $A_1$ and $A_2$ are most preferably hydrogen.

$R_{01}$ denotes an aliphatic, aromatic or heterocyclic group. $R_{01}$ is particularly preferably phenyl, substituted alkyl having 1 to 3 carbon atoms, or alkenyl. With regard to the phenyl and substituted alkyl groups having 1 to 3 carbon atoms thereamong, the preferred range is the same as that described above for $R_{02}$. As for the alkenyl group, $R_{01}$ is preferably vinyl, and particularly preferably vinyl having one or two substituents chosen from cyano, acyl, alkoxycarbonyl, nitro, trifluoromethyl, carbamoyl, etc. In detail, 2,2-dicyanovinyl, 2-cyano-2-methoxycarbonylvinyl, 2-acetyl-2-ethoxycarbonylvinyl, etc. can be cited.

In general formula (1), $R_{01}$ may be a group able to undergo a cyclization in which a cyclic structure including the atoms of the $-G_1-R_{01}$ moiety is formed while being separated from the remainder of the molecule. The hydrazine derivatives represented by general formula (1) may incorporate an adsorbable group which can be adsorbed on a silver halide. $R_{01}$ or $R_{02}$ in general formula (1) may incorporate a ballast group or a polymer commonly used as an immobile photographic additive such as a coupler. Furthermore, $R_{01}$ or $R_{02}$ in general formula (1) may contain a plurality of hydrazino groups as substituents, and in this case the compound represented by general formula (1) denotes a multimer in respect of the hydrazino groups. Moreover, $R_{01}$ or $R_{02}$ in general formula (1) may contain a cationic group (in detail, a group containing quaternary ammonium, a nitrogen-containing heterocyclic group containing quaternary nitrogen, etc.), a group containing a repeating ethyleneoxy or propyleneoxy unit, (alkyl, aryl or heterocyclic) thio, or a dissociable group which can be dissociated by a base (carboxy, sulfo, acylsulfamoyl, carbamoylsulfamoyl, etc.). With regard to examples thereof, compounds as in, for example, JP-A-63-29751, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246, JP-A-2-285344, JP-A-1-100530, JP-A-64-86134, JP-A-4-16938, JP-A-5-197091, WO95/32452, WO95/32453, JP-A-9-235264, JP-A-9-235265, JP-A-9-235266, JP-A-9-235267, JP-A-9-179229, JP-A-7-234471, JP-A-5-333466, JP-A-6-19032, JP-A-6-19031, JP-A-5-45761, U.S. Pat. Nos. 4,994,365 and 4,988,604, JP-A-7-5610, JP-A-7-244348, German Patent No. 4,006,032, etc. can be cited.

Detailed examples of the compounds represented by general formula (1) are listed below, but the present invention is in no way limited thereby.

Y—NHNH—X

| Y = | X = 1 | 2 | 3 | 4 | 5 |
|---|---|---|---|---|---|
| 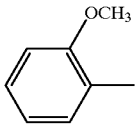 | 1a | 1b | 1c | 1d | 1e |

-continued
| | | | | | |
|---|---|---|---|---|---|
| 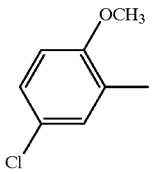 | 2a | 2b | 2c | 2d | 2e |
| 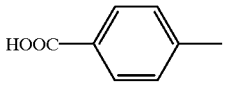 | 3a | 3b | 3c | 3d | 3e |
| 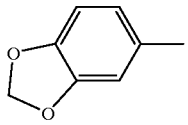 | 4a | 4b | 4c | 4d | 4e |
| 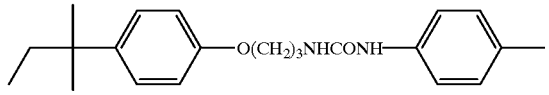 | 5a | 5b | 5c | 5d | 5e |
1: —CHO
2: —$COCH_2OH$
3: —$COCH_2NHSO_2CH_3$
4:
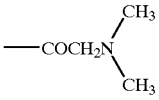
5:
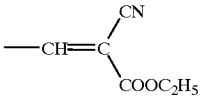
Y—NHNH—X
| | X = | | | | |
|---|---|---|---|---|---|
| Y = | 1 | 2 | 3 | 4 | 5 |
| 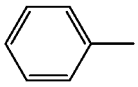 | 6a | 6b | 6c | 6d | 6e |
| 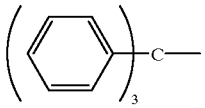 | 7a | 7b | 7c | 7d | 7e |
| 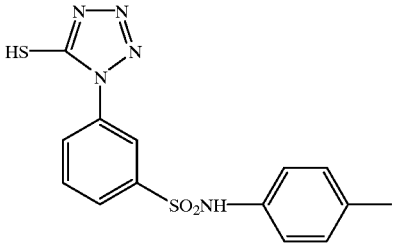 | 8a | 8b | 8c | 8d | 8e |

-continued
| | | | | | |
|---|---|---|---|---|---|
| 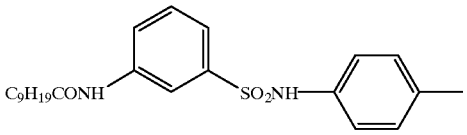 | 9a | 9b | 9c | 9d | 9e |
| 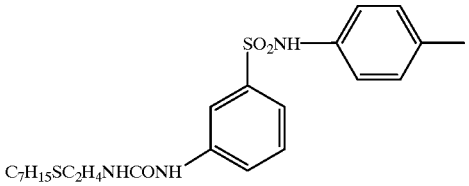 | 10a | 10b | 10c | 10d | 10e |
1:
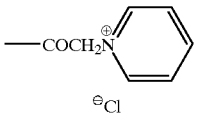
2:
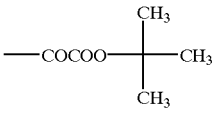
3:
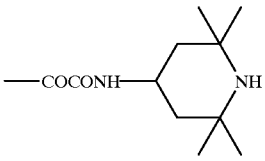
4: —$COCHF_2$
5: —$COC_2F_4COOK$
11
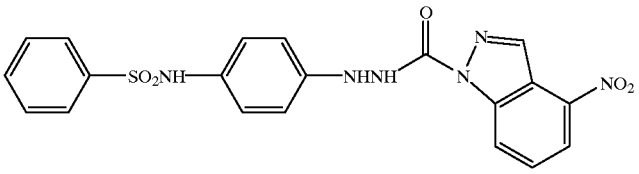
12
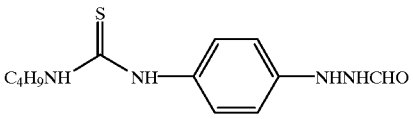
13
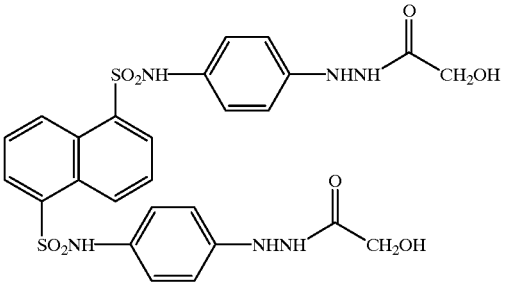

-continued
14
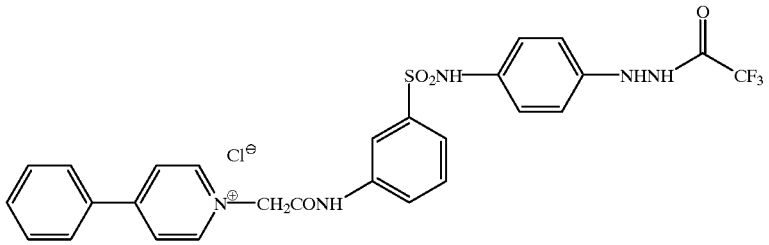
15
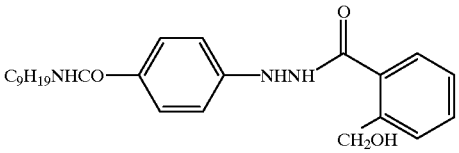
16
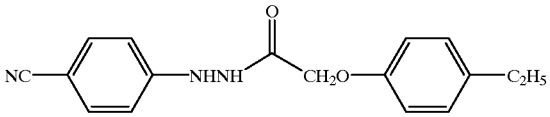
17
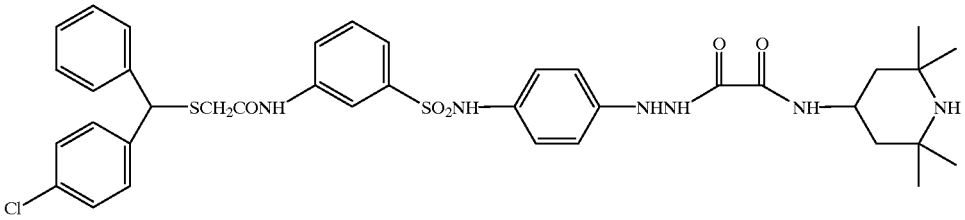
18
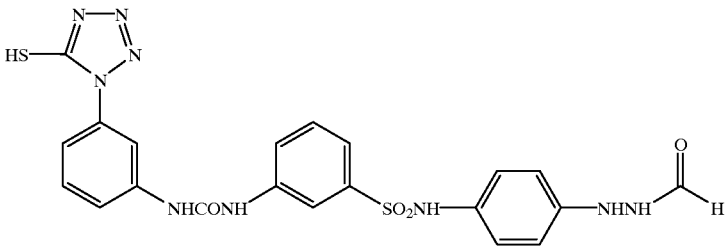
19
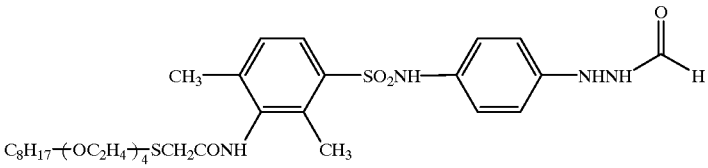
20
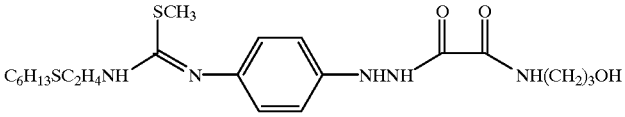
21
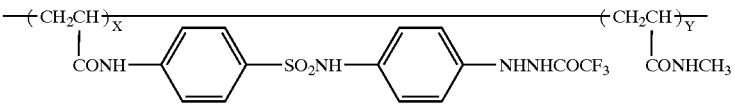
X:Y = 3:97
Average molecular weight 100,000

-continued

22

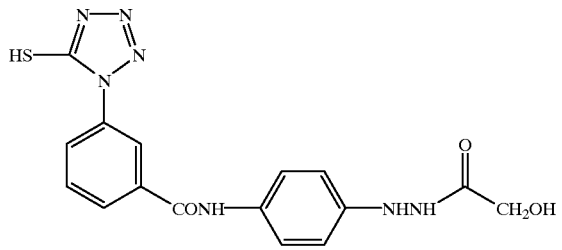

23

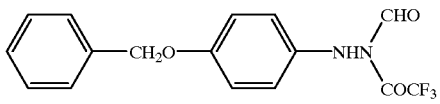

24

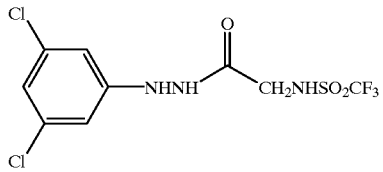

25

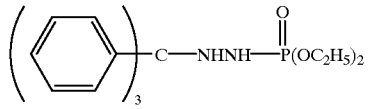

The hydrazine derivatives used in the present invention may be used singly or in combinations of more than one type. In addition to the above-mentioned compounds, the hydrazine derivatives below can also be preferably used. (They may be used in combination.) The hydrazine derivatives used in the present invention can be synthesized by various methods as in the patents below. That is to say, all hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and European Patent No. 741,320A.

The hydrazine derivatives can be used by dissolving them in water or an appropriate organic solvent such as, for example, an alcohol (methanol, ethanol, propanol, fluorinated alcohol), a ketone (acetone, methyl ethyl ketone), dimethylformamide, dimethyl sulfoxide or methyl Cellosolve. Alternatively, they can be made into an emulsified dispersion obtained mechanically by the well known emulsion dispersion method involving dissolving them in an oil such as dibutyl phthalate, tricresyl phosphate, glyceryl triacetate or diethyl phthalate or an auxiliary solvent such as ethyl acetate or cyclohexanone. They can also be used by a method known as solid dispersion which involves dispersing the powdered hydrazine derivative in an appropriate solvent such as water by means of a ball mill, a colloid mill or by ultrasound.

The hydrazine derivatives used in the present invention may be added to the image-recording layer or any other layer on the image-recording layer side of the support, but it is preferable for them to be added to the image-recording layer or an adjacent layer. The amount of hydrazine derivative added in the present invention is preferably $1\times10^{-6}$ to 1 mol per mol of silver, more preferably $1\times10^{-5}$ to $5\times10^{-1}$ mol, and most preferably $2\times10^{-5}$ to $2\times10^{-1}$ mol.

Other examples of the compounds preferred as the electron-transfer agent include substituted alkene derivatives, substituted isoxazole derivatives and specified acetal compounds represented by general formulae (3) to (5) below. The compounds represented by general formula (3), general formula (4) and general formula (5) are explained below.

(3)

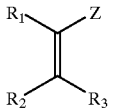

(4)

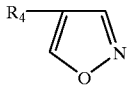

(5)

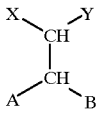

In general formula (3) $R_1$, $R_2$ and $R_3$ independently represent hydrogen or a substituent, and Z represents an electron-withdrawing group. In general formula (3), $R_1$ and Z; $R_2$ and $R_3$; $R_1$ and $R_2$; or $R_3$ and Z may be bonded together to form a cyclic structure. In general formula (4), $R_4$ represents a substituent. In general formula (5), X and Y independently represent hydrogen or a substituent; A and B independently represent alkoxy, alkylthio, alkylamino, aryloxy, arylthio, anilino, heterocyclic oxy, heterocyclic thio or heterocyclic amino. In general formula (5), X and Y, and A and B may be bonded together to form a cyclic structure.

In general formula (3), $R_1$, $R_2$ and $R_3$ may be, for example, halogen atoms (fluorine, chlorine, bromine or iodine), alkyl (including aralkyl, cycloalkyl and active methine), alkenyl, alkynyl, aryl, heterocyclic (including N-substituted nitrogen-containing heterocycles), heterocycles containing quaternized nitrogen (e.g. pyridinio), acyl, alkoxycarbonyl, aryloxycarbonyl, carbamoyl, carboxyl or salts thereof, imino, nitrogen-substituted imino, thiocarbonyl, sulfonylcarbamoyl, acylcarbamoyl, sulfamoylcarbamoyl, carbazolyl, oxalyl, oxamoyl, cyano, thiocarbamoyl, hydroxyl, alkoxy (including groups containing repeating ethylenoxy or propylenoxy units), aryloxy, heterocyclic oxy, acyloxy, aryloxy, (alkoxy or aryloxy) carbonyloxy, carbamoyloxy, sulfonyloxy, amino, (alkyl, aryl or heterocyclic) amino, acylamino, sulfonamido, ureido, thioureido, isothioureido, imido, (alkoxy or aryloxy) carbonylamino, sulfamoylamino, semicarbazido, thiosemicarbazido, hydrazino, quaternary ammonium, oxamoylamino, (alkyl or aryl) sulfonylureido, acylureido, acylsulfamoylamino, nitro, mercapto, (alkyl, aryl or heterocyclic) thio, acylthio, (alkyl or aryl) sulfonyl, (alkyl or aryl) sulfinyl, sulfo or salts thereof, phosphoryl, groups containing a phosphate amide or phosphate ester structure, silyl and stannyl. These substituents may further be substituted with these substituents.

The electron-withdrawing group represented by Z in general formula (3) is a substituent having a positive Hammett σ-para constant, typified by cyano, alkoxycarbonyl, aryloxycarbonyl, carbamoyl, imino, nitrogen-substituted imino, thiocarbonyl, sulfamoyl, alkylsulfonyl, arylsulfonyl, nitro, halogen, perfluoroalkyl, perfluoroalkanamido, sulfonamido, acyl, formyl, phosphoryl, carboxy, sulfo (or a salt thereof, heterocyclic, alkenyl, alkynyl, acyloxy, acylthio, sulfonyloxy, or aryl substituted by these electron-withdrawing groups. Here, the heterocyclic group is defined as an aromatic or non-aromatic, saturated or unsaturated heterocyclic group, typified by pyridyl, quinolyl, pyrazinyl, benzotriazolyl, imidazolyl, benzimidazolyl, hydantoin-1-yl, urazol-1-yl, succinimido and phthalimido. The electron-withdrawing group represented by Z in general formula (3) may further have any substituent.

The electron-withdrawing group represented by Z in formula (3) is preferably one having a total of 0 to 30 carbon atoms, typified by cyano, alkoxycarbonyl, aryloxycarbonyl, carbamoyl, thiocarbonyl, imino, nitrogen-substituted imino, sulfamoyl, alkylsulfonyl, arylsulfonyl, nitro, perfluoroalkyl, acyl, formyl, phosphoryl, acyloxy, acylthio or phenyl substituted by any electron-withdrawing group. Among these, more preferable are cyano, alkoxycarbonyl, carbamoyl, thiocarbonyl, imino, nitrogen-substituted imino, sulfamoyl, alkylsulfonyl, arylsulfonyl, acyl, formyl, phosphoryl, trifluoromethyl or phenyl substituted by any electron-withdrawing group; and still more preferable are cyano, alkoxycarbonyl, carbamoyl, imino, nitrogen-substituted imino, alkylsulfonyl, arylsulfonyl, acyl and formyl.

The substituent represented by $R_1$ in general formula (3) is preferably a group having a total of 0 to 30 carbon atoms, and can be exemplified by groups defined in the same way as the above-described electron-withdrawing group represented by Z in general formula (3), as well as by alkyl, alkenyl, alkoxy, aryloxy, heterocyclic oxy, alkylthio, arylthio, heterocyclic thio, amino, alkylamino, arylamino, heterocyclic amino, ureido, acylamino, silyl, or substituted or unsubstituted aryl. Among these, more preferable are groups defined in the same way as the above-described electron-withdrawing group represented by Z in general formula (3), as well as substituted or unsubstituted aryl, alkenyl, alkylthio, arylthio, alkoxy, silyl and acylamino; and still more preferable are electron-withdrawing groups, aryl, alkenyl and acylamino. When $R_1$ represents an electron-withdrawing group, the preferable range thereof is the same as that for the electron-withdrawing group represented by Z.

The substituent represented by $R_2$ or $R_1$ in general formula (3) is preferably a group defined in the same way as the above-described electron-withdrawing group represented by Z in general formula (3), as well as alkyl, hydroxyl (or a salt thereof), mercapto (or a salt thereof, alkoxy, aryloxy, heterocyclic oxy, alkylthio, arylthio, heterocyclic thio, amino, alkylamino, anilino, heterocyclic amino, acylamino, and substituted or unsubstituted phenyl. It is more preferable that either $R_2$ or $R_3$ represents hydrogen and the other represents a substituent. Such a substituent is preferably alkyl, hydroxyl (or a salt thereof), mercapto (or a salt thereof, alkoxy, aryloxy, heterocyclic oxy, alkylthio arylthio, heterocyclic thio, amino, alkylamino anilino, heterocyclic amino, acylamino (more specifically, perfluoroalkaneamido), sulfonamido, substituted or unsubstituted phenyl or a heterocyclic group. Still more preferable are hydroxyl (or a salt thereof, mercapto (or a salt thereof, alkoxy, aryloxy, heterocyclic oxy, alkylthio, arylthio, heterocyclic thio, amino, and a heterocyclic group; and most preferable are hydroxyl (or a salt thereof, alkoxy and a heterocyclic group.

It is also preferable that Z and $R_1$; or $R_2$ and $R_3$ in general formula (3) may be bonded together to form a cyclic structure. The cyclic structure thus formed is an aromatic or non-aromatic heterocycle, preferably having a five- to seven-membered cyclic structure, preferably having a total of 1 to 40 carbon atoms, and more preferably 3 to 35.

Among the compounds represented by general formula (3), one more preferable example is a compound in which Z represents any one of cyano, formyl, acyl, alkoxycarbonyl, imino and carbamoyl, $R_1$ represents an electron-withdrawing group; either $R_2$ or $R_3$ represents hydrogen and the other represents any one of hydroxyl (or a salt thereof, mercapto (or a salt thereof, alkoxy, aryloxy, heterocyclic oxy, alkylthio, arylthio, heterocyclic thio, amino and a heterocyclic group. Among the compounds represented by general formula (3), another more preferable example is a compound in which Z and $R_1$ are bonded together to form a non-aromatic five- to seven-membered ring structure; either $R_2$ or $R_3$ represents hydrogen and the other represents any one of hydroxyl (or a salt thereof, mercapto (or a salt thereof), alkoxy, aryloxy, heterocyclic oxy, alkylthio, arylthio, heterocyclic thio, amino and a heterocyclic group.

The non aromatic five- to seven-membered ring formed by Z and $R_1$ is specifically an indane-1,3-dione ring; a pyrrolidine-2,4-dione ring; a pyrazolidine-3,5-dione ring; an oxazolidine-2,4-dione ring; a 5-pyrazolone ring; an imidazolidine-2,4-dione ring; a thiazolidine-2,4-dione ring; an oxolan-2,4-dione ring; a thiolan-2,4-dione ring; a 1,3-dioxane-4,6-dione ring, a cyclohexane-1,3-dione ring; a 1,2,3,4-tetrahydroquinoline-2,4-dione ring, a cyclopentane-1,3-dione ring; an isooxazolidine-3,5-dione ring; a barbituric acid ring; a 2,3-dihydrobenzofuran-3-one ring; a pyrazolotriazole ring (e.g. 7H-pyrazolo[1,5-b][1,2,4]triazole, 7H-pyrazolo[5,1-c][1,2,4]triazole, 7H-pyrazolo[1,5-a] benzimidazole); a pyrrolotriazole ring (e.g. 5H-pyrrolo[1,2-b][1,2,4] triazole, 5H-pyrrolo[2,1-c][1,2,4]triazole); a 2-cyclopentene-1,3-dione ring; a 2,3-dihydrobenzothiophene-3-one-1,1-dioxide ring; a chroman-2,4-dione ring; or an oxazolin-5-one ring. Among these, more preferable are an indane-1,3-dione ring; a pyrrolidine-2,4-dione ring; a pyrazolidine-3,5-dione ring; a 5-pyrazolone ring; a barbituric acid ring; and an oxazolin-5-one ring.

The substituent represented by $R_4$ in general formula (4) can be exemplified by those described for $R_1$ to $R_3$ in general formula (3). The substituent represented by $R_4$ in general formula (4) is preferably an electron-withdrawing group or aryl. When $R_4$ represents an electron-withdrawing group, preferably with a total of 0 to 30 carbon atoms, it can be exemplified by cyano, nitro, acyl, formyl, alkoxycarbonyl, aryloxycarbonyl, alkylsulfonyl, arylsulfonyl, carbamoyl, sulfamoyl, perfluoroalkyl, phosphoryl, imino, sulfonamido and a heterocyclic group. Among these, more preferable are cyano, acyl, formyl, alkoxycarbonyl, carbamoyl, sulfamoyl, alkylsulfonyl, arylsulfonyl, sulfonamido and a heterocyclic group.

When $R_4$ represents aryl, it is preferably a substituted or unsubstituted phenyl with a total of 0 to 30 carbon atoms, the substituents of which can be exemplified by those described for $R_1$, $R_2$ and $R_3$ in general formula (3) where $R_1$, $R_2$ and $R_3$ represent the substituents. Among these, electron-withdrawing groups are preferable.

The substituents represented by X and Y in general formula (5) can be exemplified by those described for $R_1$ to $R_3$ in general formula (3). The substituents represented by X and Y preferably have a total of 1 to 50 carbon atoms, and more preferably 1 to 35, and are exemplified by cyano, alkoxycarbonyl, aryloxycarbonyl, carbamoyl, imino, nitrogen-substituted imino, thiocarbonyl, sulfamoyl, alkylsulfonyl, arylsulfonyl, nitro, perfluoroalkyl, acyl, formyl, phosphoryl, acylamino, acyloxy, acylthio, a heterocyclic group, alkylthio, alkoxy and aryl. Among these, more preferable are cyano, nitro, alkoxycarbonyl, carbamoyl, acyl, formyl, acylthio, acylamino, thiocarbonyl, sulfamoyl, alkylsulfonyl, arylsulfonyl, imino, nitrogen-substituted imino, phosphoryl, trifluoromethyl, a heterocyclic group and substituted phenyl. Still more preferable are cyano, alkoxycarbonyl, carbamoyl, alkylsulfonyl, arylsulfonyl, acyl, acylthio, acylamino, thiocarbonyl, formyl, imino, nitrogen-substituted imino, a heterocyclic group and phenyl substituted by any substituent.

It is also preferable that X and Y are bonded together to form a non-aromatic carbon ring or non-aromatic hetero ring. The rings thus formed are preferably five- to seven-membered, and can specifically be exemplified by the non-aromatic five- to seven-membered rings generated by the bonding together of Z and $R_1$ in general formula (3), the preferable range therefor being the same. These rings may also have further substituents and may have a total of 1 to 40 carbon atoms, and more preferably 1 to 35.

The substituents represented by A and B in general formula (5) may also have further substituents and may have a total of 1 to 40 carbon atoms, and more preferably 1 to 30.

A more preferable case relates to that in which A and B in general formula (3) are bonded together to form a cyclic structure. The cyclic structure thus obtained is preferably a five- to seven-membered non-aromatic hetero ring with a total of 1 to 40 carbon atoms, and more preferably 3 to 30. The structures bound between A and B include, for example, —O—$(CH_2)_2$—O—, —O—$(CH_2)_3$—O—, —S—$(CH_2)_2$—S—, —S—$(CH_2)_2$—S—, —S—Ph—S—, —N($CH_3$)—$(CH_2)_2$—O—, —O—$(CH_2)_3$—S—, —N($CH_3$)—Ph—S—, and —N(Ph)—$(CH_2)_2$—S—.

The compounds represented by general formulae (3) to (5) in the present invention may incorporate an adsorbable group which can be adsorbed on a silver halide. Such group may be a ballast group or a polymer commonly used as an immobile photographic additive such as a coupler; a cationic group (e.g. a group containing quaternary ammonium, or a nitrogen-containing hetero ring containing a quaternized nitrogen atom); a group containing repeating ethyleneoxy or propyleneoxy units; (alkylaryl or heterocyclic) thio; or a dissociable group capable of dissociating in the presence of a base (e.g. carboxyl, sulfo, acylsulfamoyl, carbamoylsulfamoyl). Examples of these groups are disclosed in JP-A-63-29751, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246, JP-A-2-285344, JP-A-1-100530, JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348 and German Patent No. 4,006,032.

Typical examples of the compounds represented by general formulae (3) to (5) used in the present invention are listed below, while not particularly being limited thereto.

1

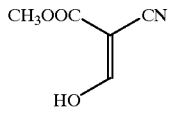

2

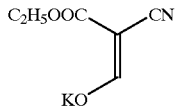

3

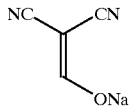

4

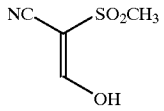

5

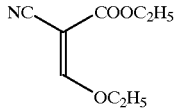

6

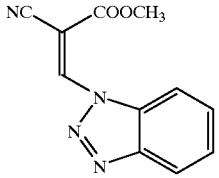

7

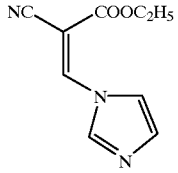

8

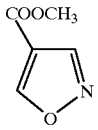

-continued
9
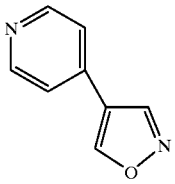
10
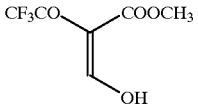
11
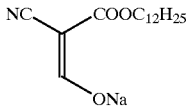
12
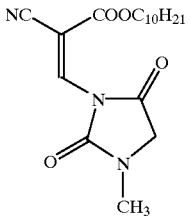
13
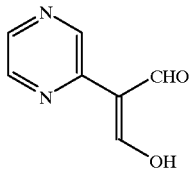
14
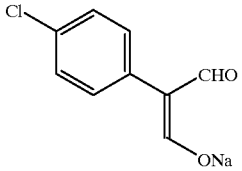
15
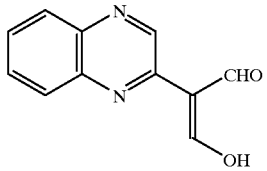
16
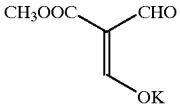
17
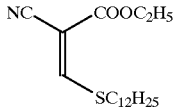
-continued
18
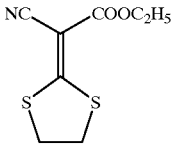
19
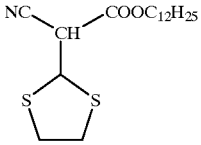
20
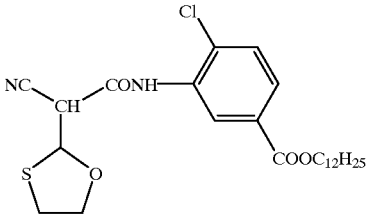
21
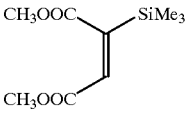
22
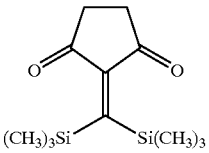
23
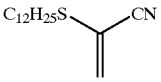
24
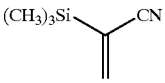
25
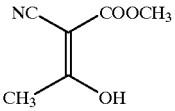
26
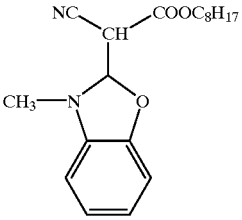

-continued
27
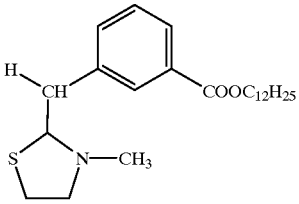
28
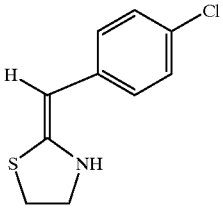
29
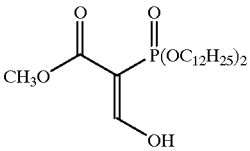
30
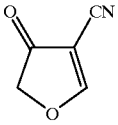
31
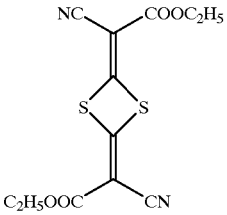
32
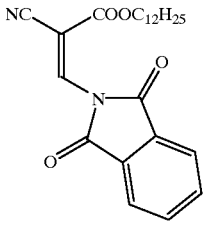
33
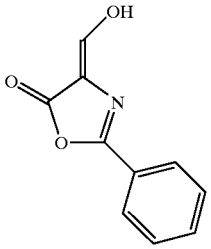
-continued
34
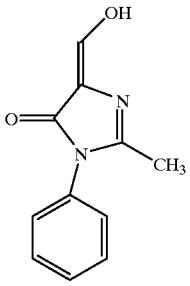
35
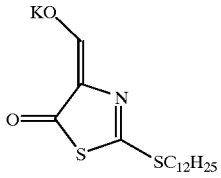
36
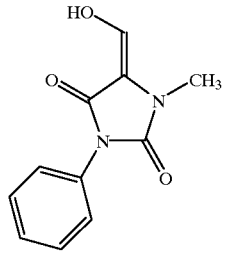
37
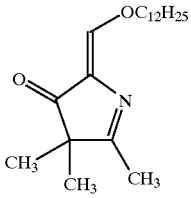
38
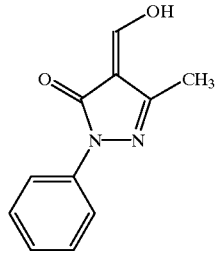
39
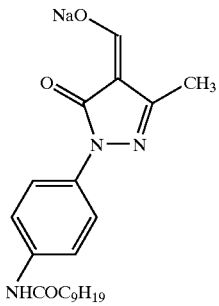

-continued
40
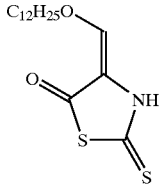
41
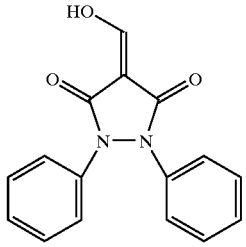
42
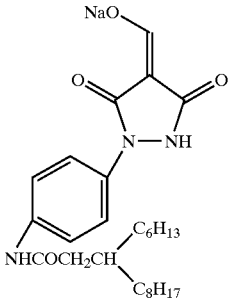
43
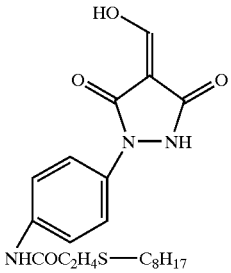
44
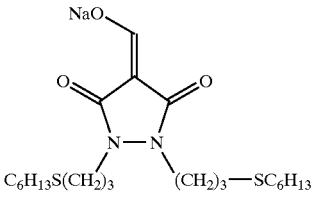
45
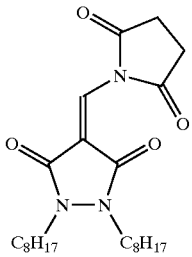
-continued
46
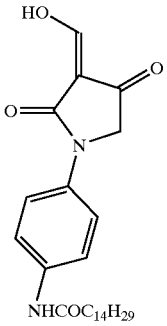
47
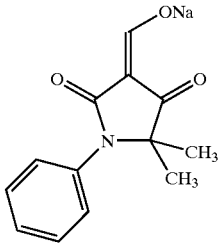
48
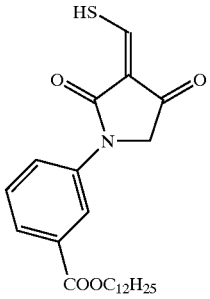
49
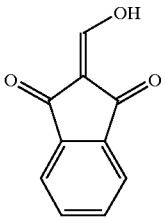
50
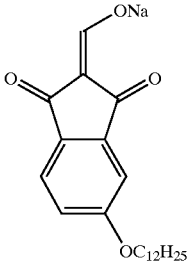
51
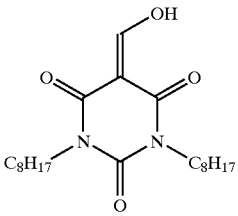

-continued
52
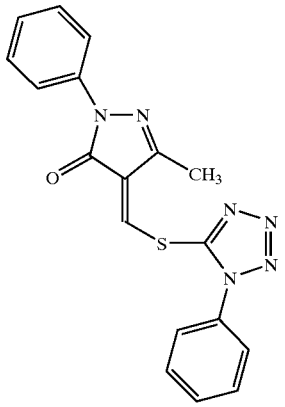
53
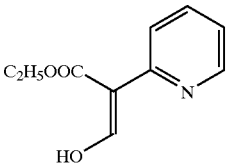
54
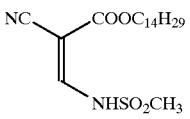
55
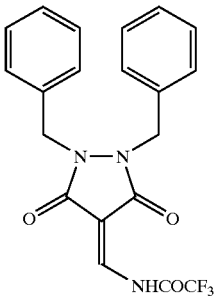
56
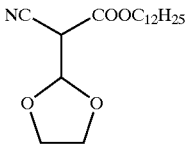
57
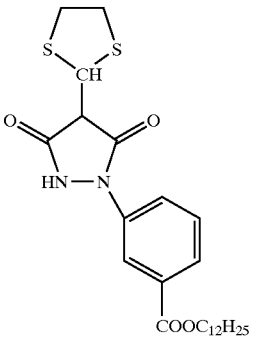
-continued
58
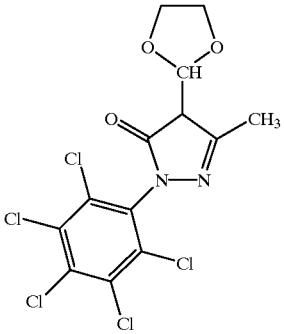
59
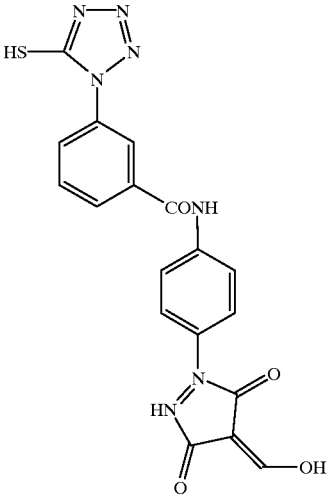
60
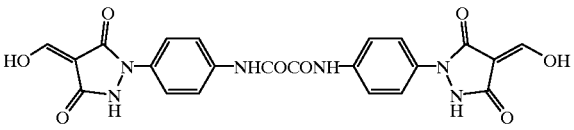
61
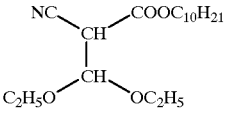
62
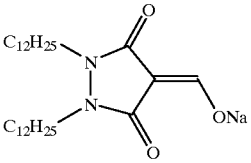
63
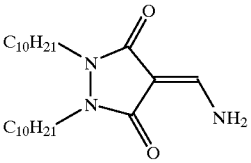

-continued

64

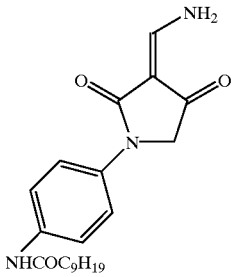

65

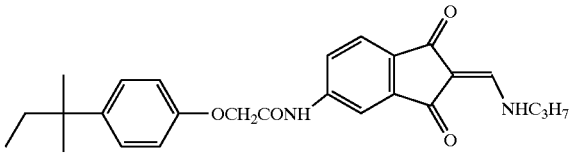

66

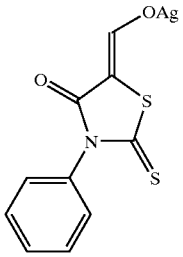

67

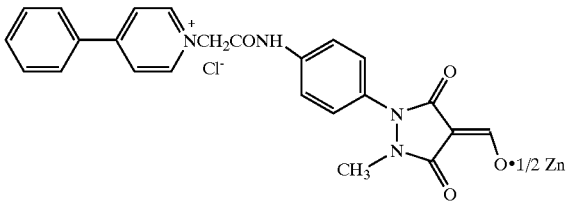

68

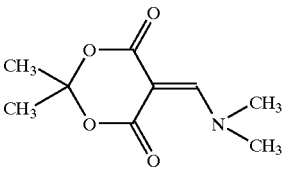

69

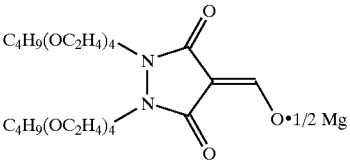

-continued

70

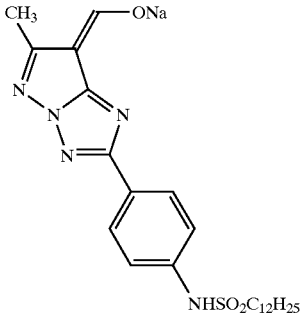

71

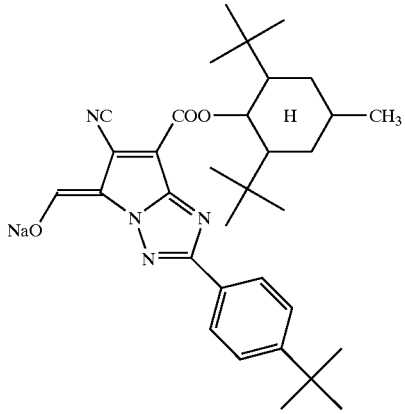

72

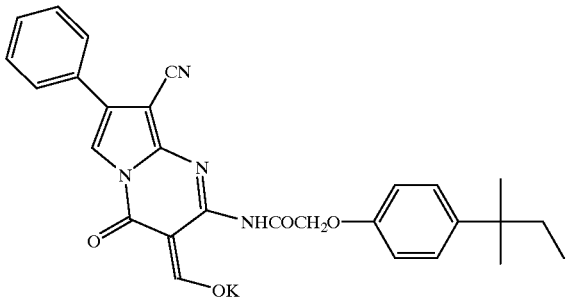

The compounds represented by general formulae (3) to (5) can easily synthesized according to known methods referring, for example, to U.S. Pat. Nos. 5,545,515, 5,635,339 and 5,654,130, International Patent Publication WO97/34196 or JP-A-11-231459, JP-A-11-133546 and JP-A-11-095365.

The compounds represented by general formulae (3) to (5) may be used individually or in combinations of two or more thereof. In addition to these compounds, compounds described in U.S. Pat. Nos. 5,545,515, 5,635,339, 5,654,130, 5,705,324 and 5,686,228, JP-A-10-161270, JP Application No. 9-273935, JP-A-11-231459, JP-A-11-133546, JP-A-11-119372, JP-A-11-109546, JP-A-11-095365, JP-A-11-

095366 and JP-A-11-149136 may also be used in combination. In the present invention, various hydrazine derivatives disclosed in JP-A-10-161270 can also be used in combination.

The compounds represented by formulae (3) to (5) can be used in the present invention by dissolving them in water or an appropriate organic solvent such as an alcohol (methanol, ethanol, propanol, a fluorinated alcohol), a ketone (acetone, methyl ethyl ketone), dimethylformamide, dimethylsulfoxide or methyl Cellosolve.

Alternatively, they can be made into an emulsified dispersion obtained mechanically by the well-known emulsion dispersion method involving dissolving them in an oil such as dibutyl phthalate, tricresyl phosphate glyceryl triacetate or diethyl phthalate or an auxiliary solvent such as ethyl acetate or cyclohexanone. They can also be used by a method known as solid dispersion which involves dispersing the powdered compound in water by means of a ball mill, a colloid mill or by ultrasound.

The compounds of general formulae (3) to (5) used in the present invention can be added to any layer provided on the image-forming layer side of the support, but it is preferable for them to be added to the image-forming layer or an adjacent layer.

The amount of the compounds of general formulae (3) to (5) used in the present invention is preferably from $1\times10^{-6}$ to 1 mol per mol of silver, more preferably from $1\times10^{-5}$ to 5×10−1 mol, and still more preferably from $2\times10^{-5}$ to $2\times10^{-1}$ mol.

The heat-developable image-recording material of the present invention preferably contains a reducing agent for reducing an organic silver salt. The reducing agent for reducing the organic silver salt may be any substance capable of reducing silver ion into metallic silver, and is preferably an organic substance. While conventional photographic developers such as phenidone, hydroquinone and catechol are useful, a hindered phenol reducing agent is preferred. The particularly preferred reducing agent is a poly hindered phenol having at least two hindered phenols in its molecular structure. The reducing agent is preferably contained in an amount of from 10 to 150 mol %, more preferably from 20 to 100 mol % per mol of silver present on the side where the image-forming layer is provided. The layer to which the reducing agent is added may be any layer on the side having the image-forming layer. It is preferably added to a silver-supplying layer or a photosensitive layer. It may be added to both a silver-supplying layer and a photosensitive layer. It is preferably added to a silver-supplying layer or both a silver-supplying layer and a photosensitive layer. The reducing agent may also be a so-called precursor that is derivatized to effectively exhibit its function only at the time of development.

For heat-developable photosensitive materials using an organic silver salt, a wide variety of reducing agents are known, for example, in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,958, 3,679,426, 3,751,252, 3,751,255, 3,761,270, 3,782,949, 3,839,048, 3,928,686 and 5,464,738, German Patent No. 2321 328 and European Patent No. 692,732. Examples thereof include amidoximes such as phenylamidoxime, 2-thienylamidoxime and p-phenoxyphenylamidoxine; azines such as 4-hydroxy-3,5-dimethoxybenzaldehyde azine; combinations of an aliphatic carboxylic acid arylhydrazide with an ascorbic acid, such as a combination of 2,2'-bis(hydroxymethyl) propionyl-β-phenylhydrazine with ascorbic acid; combinations of a polyhydroxybenzene with a hydroxylamine, a reductone and/or a hydrazine (e.g. a combination of hydroquinone with bis(ethoxyethyl) hydroxylamine, piperidinohexose reductone or formyl-4-methylphenylhydrazine); hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of a bis-β-naphthol with a 1,3-dihydroxybenzene derivative (e.g. 2,4-dihydroxybenzophenone or 2',4'-dihydroxyacetophenone); 5-pyrazolones such as 3-methyl-1-phenyl-5-pyrazolone; reductones such as dimethylaminohexose reductone, anhydrodihydroami nohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridi nes such as 2,6-dimethoxy-1,5-dicarboethoxy-1,4-dihydropyridine; bisphenols such as bis(2-hydroxy-3-t-butyl-5-methylphenyl) methane, 2,2-bis(4-hydroxy-3-methylphenyl) propane, 4,4-ethylidene-bis(2-t-butyl-6-methylphenol), 1,1-bis (2-hydroxy-3,5-dimethyl phenyl)-3,5,5-trimethyl hexane and 2,2-bis(3,5-dimethyl-4-hydroxyphenyl) propane; ascorbic acid derivatives such as 1 ascorbyl palmitate and ascorbyl stearate; aldehydes and ketones such as benzil and biacetyl; 3-pyrazolidone and particular indane-1,3-diones; and chromanols (e.g. tocopherol). Particularly preferred reducing agents are bisphenols and chromanols.

The reducing agent used in the present invention may be added in any form such as a solution, powder or a solid microparticle dispersion. Dispersion of the solid microparticles is effected using a known pulverizing means (e.g. ball mill, vibrating ball mill, sand mill, colloid mill, jet mill or roller mill). A dispersion aid may be used for dispersing the solid microparticles.

Next, the photosensitive silver halide used in the present invention will be described in detail.

The photosensitive silver halide used in the present invention has no limitation with regard to its halogen composition, and any of silver chloride, silver chlorobromide, silver bromide, silver iodobromide and silver iodochlorobromide is available. The halogen composition distribution within the grains may be uniform, or the halogen composition may be changed stepwise or continuously. Silver halide grains with a core/shell structure may preferably be used, preferably with a two- to five-fold structure, and more preferably a two- to four-fold structure. It is also preferable to adopt a technique for localizing silver bromide on the surface of silver chloride or silver cholorobromide.

Methods for producing a photosensitive silver halide used in the present invention are well known in the art, and, for example, the methods described in Research Disclosure, No. 17029 (June, 1978) and U.S. Pat. No. 3,700,458 may be applied. The methods applicable to the present invention include those such as adding a halogen-containing compound to a prepared organic silver salt to convert a part of the silver contained therein into a photosensitive silver halide, and adding a silver-supplying compound and a halogen-supplying compound to gelatin or other polymer solution to thereby prepare photosensitive silver halide grains which are then mixed with an organic silver salt, where the latter method is more preferable. The photosensitive silver halide grains preferably have a small grain size so as to prevent white turbidity after image production. Specifically, the grain size is preferably 0.20 μm or less, more preferably from 0.01 to 0.15 μm, and still more preferably from 0.02 to 0.12 μm. The term "grain size" as used herein means the length of an edge of the silver halide grain in the case where the grain is a normal crystal having a cubic or octahedral shape, means the diameter of a circular image having an area equal to the projected area of the major plane of the silver halide grain in the case where the grain is a platelet, and means the diameter of a sphere having a volume equal to that of the silver halide grain in the case where the grain has some other irregular shape such as a sphere or a rod.

Examples of the shapes of the silver halide grains include cubic, octahedral, platelet, spherical, rod and pebble; among these, cubic and platelet shapes are preferred in the present invention. When platelet silver halide grains are used, the average aspect ratio is preferably from 100:1 to 2:1, and more preferably from 50:1 to 3:1. Silver halide grains having rounded corners are also preferably used. The plane indices (Miller indices) of the outer surface plane of the photosensitive silver halide grains are not particularly limited; however, it is preferred that there is a large percentage of the [100] plane showing a high spectral sensitization efficiency upon adsorption of a spectral sensitizing dye. The percentage is preferably 50% or above, more preferably 65% or above, and still more preferably 80% or above. The percentage of a plane with a Miller index of [100] can be determined by the method described in T. Tani, J. Imaging Sci., 29,165 (1985), which is based on the plane dependency of adsorption of the sensitizing dye between the [111] and [100] planes.

The photosensitive silver halide grains for use in the present invention preferably contain a Group VII metal or Group VIII metal in the Periodic Table, or a metal complex. The Group VII metal or Group VIII metal in the Periodic Table, or the central metal of the metal complex is preferably rhodium, rhenium, ruthenium, osmium or iridium. These metal complexes may be used individually, or in combinations of two or more complexes of the same metal or different metals. The metal complex content is preferably from $1\times10^{-9}$ to $1\times10^{-2}$ mol per mol of silver, and more preferably from $1\times10^{-8}$ to $1\times10^{31\ 4}$ mol. With respect to the specific structure of the metal complexes, those having the structures described in JP-A-7-225449 may be used.

The rhodium compound preferably used in the present invention is a water-soluble rhodium compound. Examples thereof include rhodium(III) halide compounds; and rhodium complex salts having a halogen, amine or oxalate as ligands, such as hexachlororhodium(III) complex salts, pentachloroaquorhodium(III) complex salts, tetrachlorodiaquorhodium(III) complex salts, hexabromorhodium(III) complex salts, hexaamminerhodium(III) complex salts and trioxalatorhodium(III) complex salts. These rhodium compounds are used in a dissolved form in water or other appropriate solvent, where a method commonly used for stabilizing the rhodium compound solution may be applied, in which an aqueous hydrogen halide solution (e.g. hydrochloric acid, hydrobromic acid, hydrofluoric acid) or an alkali halide (e.g. KCl, NaCl, KBr, NaBr) is added. In place of using the water-soluble rhodium compound, separate silver halide grains predoped with rhodium may be added and dissolved when the silver halide is prepared.

The amount of the rhodium compound added is preferably from $1\times10^{-8}$ to $5\times10^{-6}$ mol per mol of silver halide, and more preferably from $5\times10^{-8}$ to $1\times10^{-6}$ mol.

The rhodium compound may appropriately be added when the silver halide emulsion grains are produced or at the respective stages before the coating of the emulsion, and it is more preferable to add the compound when the emulsion is produced so that it is incorporated into the silver halide grains.

The rhenium, ruthenium or osmium for use in the present invention is added in the form of a water-soluble complex salt described in JP-A-63-2042, JP-A-1-285941, JP-A-2-20852 and JP-A-2-20855. An exceptionally preferred example thereof is a hexacoordinate complex salt represented by the following formula:

$$[ML_6]^{n-}$$

wherein M represents Ru, Re or Os; L represents a ligand; and n represents 0, 1, 2, 3 or 4. In this case, ammonium or an alkali metal ion is used as the counter ion, the ion not being important.

Preferred examples of the ligand include halide, cyanide, cyanoxide, nitrosyl and thionitrosyl. Specific examples of the complex for use in the present invention are shown below, while not being limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RuCl_5(H_2O)]^{2-}$ |
| $[RuCl_5(NO)]^{2-}$ | $[RuBr_5\ (NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)\ (CN)_5]^{2-}$ |
| $[Os(NS)Br_5]^{2-}$ | $[Os(O)_2(CN)_4]^{4-}$ | |

The amount of these compounds added is preferably from $1\times10^{-9}$ to $1\times10^{-5}$ mol per mol of silver halide, and more preferably from $1\times10^{-8}$ to $1\times10^{-6}$ mol.

These compounds may be added appropriately when the silver halide emulsion grains are prepared or at the respective stages before the coating of the emulsion, and it is more preferable to add the compounds when the emulsion is produced so that they may be incorporated into the silver halide grains.

As for adding the compound during the silver halide grain formation and integrating it into the silver halide grains, applicable methods include those such as the pre-addition of an aqueous solution of a metal complex powder together with or without NaCl or KCl to a solution of a water-soluble salt or a water-soluble halide during the grain formation; adding the compound as a third solution when simultaneously mixing a silver salt and a halide solution to prepare silver halide grains by the triple jet method; and pouring a necessary amount of an aqueous metal complex solution into a reaction vessel during the grain formation. Among these, the method comprising adding an aqueous solution of a metal complex powder together with or without NaCl or KCl to a water-soluble halide solution is preferred.

In order to add the compound to the grain surface, a necessary amount of an aqueous metal complex solution may be charged into a reaction vessel immediately after the grain formation, during or after completion of the physical ripening, or at the time of chemical ripening.

As the iridium compound for use in the present invention, various compounds may be used, and examples thereof include hexachloroiridium, hexaammineiridium, trioxalatoiridium, hexacyanoiridium and pentachloronitrosyliridium. These iridium compounds are used in a dissolved form in water or other appropriate solvent, and a method commonly used for stabilizing the iridium compound solution may be applied in which an aqueous hydrogen halide solution (e.g. hydrochloric acid, hydrobromic acid, hydrofluoric acid) or an alkali halide (e.g. KCl, NaCl, KBr, NaBr) is added. In place of using a water-soluble iridium compound, separate silver halide grains predoped with iridium may be added and dissolved when preparing the silver halide.

The silver halide grains for use in the present invention may further contain a metal atom such as cobalt, iron, nickel, chromium, palladium, platinum, gold, thallium, copper and lead. As for cobalt, iron, chromium and ruthenium compounds, a hexacyano metal complex is preferably used. Specific examples thereof include ferricyanate ion, ferrocyanate ion, hexacyanocobaltate ion, hexacyanochromate ion and hexacyanoruthenate ion, while not being limited thereto. The phase of the silver halide, in which the metal complex is contained, is not particularly limited, and the phase may be uniform or the metal complex may be contained at a higher concentration in the core portion or in the shell portion.

The above-described metal is used preferably in an amount of from $1\times10^{-9}$ to $1\times10^{-4}$ mol per mol of silver halide. The metal may be added when preparing the grains by converting it into the form of simple salt, double salt or complex salt.

The photosensitive silver halide grains may be desalted by water washing according to a method known in the art, such as strand washing or flocculation, but the grains need not be desalted in the present invention.

The silver halide emulsion for use in the present invention is preferably subjected to chemical sensitization. The chemical sensitization may be performed using a known method such as sulfur sensitization, selenium sensitization, tellurium sensitization or noble metal sensitization. These sensitization methods may be used alone or in any combination. When these sensitization methods are used in combination, preferable combinations include sulfur and gold sensitizations; sulfur, selenium and gold sensitizations; sulfur, tellurium and gold sensitizations; and sulfur, selenium, tellurium and gold sensitizations.

The sulfur sensitization applied to the present invention is usually performed by adding a sulfur sensitizer and stirring the emulsion at a temperature of up to 40° C. or above for a predetermined time. The sulfur sensitizer may be a known compound and examples thereof include, in addition to the sulfur compound contained in gelatin, various sulfur compounds such as thiosulfates, thioureas, thiazoles and rhodanines, and thiosulfate and thiourea are preferable. Although the amount of the sulfur sensitizer that is added varies depending upon various conditions such as the pH, temperature and grain size of the silver halide at the time of chemical ripening, it is preferably from $10^{-7}$ to $10^{-2}$ mol per mol of silver halide, and more preferably from $10^{-5}$ to $10^{-3}$ mol.

The selenium sensitizer for use in the present invention may be a known selenium compound. The selenium sensitization is usually performed by adding a labile and/or non-labile selenium compound and stirring the emulsion at a temperature of up to 40° C. or above for a predetermined time. Examples of the labile selenium compound include those described in JP-B-44-15748, JP-B-43-13489, JP-A-4-25832, JP-A-4-109240, JP-A-3-121798, etc. Among these, particularly preferred are those represented by formulae (VII) and (IX) of JP-A-4-324855.

The tellurium sensitizer for use in the present invention is a compound capable of producing silver telluride, presumably to serve as a sensitization nucleus, on the surface of or inside the silver halide grains. The rate of the formation of silver telluride in a silver halide emulsion can be examined according to a method described in JP-A-5-313284. Examples of the tellurium sensitizer include diacyl tellurides, bis(oxycarbonyl) tellurides, bis(carbamoyl) tellurides, bis(oxycarbonyl) ditellurides, bis(carbamoyl) ditellurides, compounds having a P═Te bond, tellurocarboxylates, Te-organyltellurocarboxylic esters, di(poly)tellurides, tellurides, tellurols, telluroacetals, tellurosulfonates, compounds having a P—Te bond, Te-containing heterocycles, tellurocarbonyl compounds, inorganic tellurium compounds and colloidal tellurium. Specific examples thereof include the compounds described in U.S. Pat. Nos. 1,623,499, 3,320,069 and 3,772,031; British Specification Nos. 235,211, 1,121,496, 1,295,462 and 1,396,696; Canadian Patent No. 800,958; JP-A-4-204640, JP-A-4-271341, JP-A-4-333043, JP-A-5-303157; J. Chem. Soc. Chem. Commun., 635 (1980), ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986); and ibid. Vol. 2 (1987). The compounds represented by formulae (II), (III) and (IV) of JP-A-5-313284 are particularly preferred.

The amount of the selenium or tellurium sensitizer used in the present invention varies depending on the silver halide grains used and the chemical ripening conditions. However, it is generally from $10^{-8}$ to $10^{-2}$ mol per mol of silver halide, and preferably of the order of from $10^{-7}$ to $10^{-3}$ mol. The conditions for chemical sensitization in the present invention are not particularly restricted. However, in general, the pH is from 5 to 8; the pAg is from 6 to 11, preferably from 7 to 10; and the temperature is from 40 to 95° C., preferably from 45 to 85° C.

Noble metal sensitizers for use in the present invention include gold, platinum, palladium and iridium, and gold sensitization is particularly preferred. Examples of the gold sensitizers used in the present invention include chloroauric acid, potassium chloroaurate, potassium aurithiocyanate and gold sulfide, which can be used in an amount of approximately $10^{-7}$ to $10^{-2}$ mol per mol of silver halide.

As for the silver halide emulsion for use in the present invention, the production or physical ripening process for the silver halide grains may be performed in the presence of a cadmium salt, sulfite, a lead salt or a thallium salt.

In the present invention, reductive sensitization may be employed. Specific examples of compounds used in the reductive sensitization include ascorbic acid, thiourea dioxide, stannous chloride, aminoiminomethanesulfinic acid, hydrazine derivatives, borane compounds, silane compounds and polyamine compounds. The reductive sensitization may be performed by ripening the grains while keeping the emulsion at pH 7 or above, or at pAg 8.3 or below. Also, the reductive sensitization may be performed by introducing a single addition portion of silver ions during the formation of the grains.

A thiosulfonic acid compound may be added to the silver halide emulsion used in the present invention by the method described in European Patent No. 293,917.

The silver halide emulsifier may be used singly or in combinations of more than one type (for example, those which are different in terms of the average grain size, the halogen composition, the crystal habit or the chemical sensitization conditions).

The photosensitive silver halide used in the present invention is added to a photosensitive layer which is separate from the silver-supplying layer containing an organic silver salt. The amount thereof coated is from 0.01 g/m$^2$ to 5.0 g/m$^2$ on the basis of the silver content, and preferably 0.05 g/m$^2$ to 2.0 g/m$^2$.

The organic binders used in the present invention are film-forming media such as natural polymers, synthetic resin polymers, copolymers, etc. For example, there are gelatin, gum arabic, poly(vinyl alcohol), hydroxyethylcellulose, cellulose acetate, cellulose acetate butyrate, poly (vinylpyrrolidone), casein, starch, poly(acrylic acid), poly (methyl methacrylate), poly(vinyl chloride), poly (methacrylic acid), (styrene-maleic anhydride) copolymers, (styrene-acrylonitrile) copolymers, (styrene-butadiene) copolymers, poly(vinyl acetals) (e.g. poly(vinyl formal) and poly(vinylbutyral)), polyesters, polyurethanes, phenoxy resins, poly(vinylidene chloride), polyepoxides, polycarbonates, poly(vinyl acetate) and polyamides. The binders may also be formed by coating from water, an organic solvent or an emulsion.

With regard to the organic binder for the photosensitive layer and the silver-supplying layer, a polymer latex is preferred. It is preferable for the polymer latex to be present in at least 50 wt % of the total amount of binders. The polymer latex may be added not only to these layers but also to the back layer. In particular, in the case where the heat-developable image-recording material of the present invention is used in the field of printing in which a change in size is considered to be a serious problem, it is necessary to use a polymer latex in the back layer. The 'polymer latex' referred to here is a dispersion in which a water-insoluble hydrophobic polymer is dispersed in a water-soluble dispersion medium as microparticles. With regard to the dispersion state, the polymer may be emulsified in a dispersion medium, emulsion-polymerized or micelle-dispersed, or a polymer having a partial hydrophilic molecular structure may be dispersed as molecular chains in a molecular state. Details of the polymer latex can be found, for example, in "Gosei Jushi Emulsion (Synthetic Resin Emulsions)", ed. by Taira Okuda and Hiroshi Inagaki, issued by Kobunshi Kanko Kai (1978); "Gosei Latex no O-yo (Applications of Synthetic Latex)", ed. by Takaaki Sugimura, Yasuo Kataoka, Souichi Suzuki and Keiji Kasahara, issued by Kobunshi Kanko Kai (1993); and Soichi Muroi, "Gosei Latex no Kagaku (Chemistry of Synthetic Latex)", issued by Kobunshi Kanko Kai (1970). The dispersed particles preferably have an average particle size of 1 to 50,000 nm, and more preferably approximately 5 to 1,000 nm. The particle size distribution of the dispersed particles is not particularly limited, and the dispersed particles may have a broad particle size distribution or a monodisperse particle size distribution.

A so-called core/shell type latex may be used as well as an ordinary uniform polymer latex. It is preferable in some cases that the core and the shell have different glass transition temperatures (Tg).

The preferable range for the Tg of the polymer latex used as the binder in the present invention differs according to its use in the protective layer, back layer, photosensitive layer and silver-supplying layer. For use in the photosensitive layer and silver-supplying layer, the Tg is preferably 40° C. or lower, and more preferably from −30 to 40° C., so that dispersion of the photographically useful material can be accelerated during heat development. For use in the protective layer and back layer (in particular, the outermost layer), a Tg of 25 to 100° C. is preferable since the layers come into contact with various kinds of equipment.

The polymer latex for use in the present invention preferably has a minimum film-forming temperature (MFT) of from −30 to 90° C., and more preferably from 0 to 70° C. In order to control the MFT, a film-forming aid may be added. The film-forming aid, also called a plasticizer, refers to an organic compound (usually an organic solvent) capable of lowering the MFT of the polymer latex and is described in the above-mentioned "Gosei Latex no Kagaku (Chemistry of Synthetic Latex)", by Souichi Muroi, issued by Kobunshi Kanko Kai (1970).

The types of polymer in the polymer latex used in the present invention include acrylic resins, vinyl acetate resins, polyester resins, polyurethane resins, rubber-based resins, vinyl chloride resins, vinylidene chloride resins, polyolefin resins or copolymers thereof. The polymer may be a straight-chain polymer, a branched polymer or a cross-linked polymer. The polymer may be a so-called homopolymer consisting of a single kind of monomer or may be a copolymer consisting of two or more kinds of monomer. Both random copolymers and block copolymers are allowable as the copolymer. The polymer preferably has a number average molecular weight of from 5,000 to 1,000,000, and more preferably from 10,000 to 100,000. Too low a molecular weight will result in poor mechanical strength of the image-forming layer, whereas if it is too high the film-forming properties will be degraded and undesirable.

Specific examples of the polymer latex used as a binder in the photosensitive layer and silver-supplying layer of the heat-developable image-recording material of the present invention include methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, and vinylidene chloride/ethyl acrylate/acrylonitrile/methacrylic acid copolymer latex. Such polymers are also commercially available, and include acrylic resins such as Cevian A-4635, 46583 and 4601 (all produced by Daicel Kagaku Kogyo KK) and Nipol Lx811, 814, 821, 820, 857 (all produced by Nippon Zeon KK); polyester resins such as Finetex ES650, 611, 675, 850 (all produced by Dainippon Ink & Chemicals, Inc.), WD-size and WMS (both produced by Eastman Chemical); polyurethane resins such as Hydran AP10, 20, 30, 40 (all produced by Dainippon Ink & Chemicals, Inc.); rubber-based resins such as Lacstar 731 OK, 3307B, 4700H, 7132C (all produced by Dainippon Ink & Chemicals, Inc.), Nipol Lx416, 410, 438C and 2507 (all produced by Nippon Zeon KK; vinyl chloride resins such as G351, G576 (both produced by Nippon Zeon KK); vinylidene chloride resins such as L502, L513 (both produced by Asahi Chemical Industry Co., Ltd.), Aron D7020, D504 and D5071 (all produced by Mitsui Chemical Co., Ltd.); and olefin resins such as Chemipearl S120 and SA100 (both produced by Mitsui Chemical Co., Ltd.). These polymers may be used individually or, as required, as blends of two or more thereof.

With regard to the hydrophilic polymers which are present as dispersion stabilizers in the photosensitive layer, the silver-supplying layer and the protective layer in the present invention, polyvinyl alcohol, methyl cellulose, hydroxypropyl cellulose, carboxymethyl cellulose, hydroxypropylmethyl cellulose, etc. are preferably used.

The amount of hydrophilic polymer added is preferably 30 wt % or less of the total amount of binder in these layers, and more preferably 10 wt % or less. There is no particular restriction on the lower limit thereof, but it may be approximately 0.1 wt %. It is also preferable for the amount of hydrophilic polymer added to be 3 wt % or less of the total amount of binder in the protective layer, and more preferably 1 wt % or less. There is no particular restriction on the lower limit thereof, but it may be approximately 0.1 wt %.

With regard to the dispersion stabilizer surfactants used in the present invention, known anionic surfactants can be used.

Detailed examples of the surfactants are listed below, but the present invention is in no way limited thereby.

W-1 $C_{12}H_{25}-O-SO_3Na$

W-2 $C_{12}H_{25}SO_3Na$

W-3 $C_{11}H_{23}COONa$

W-4

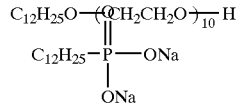

W-5

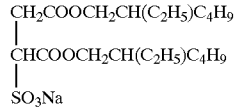

W-6

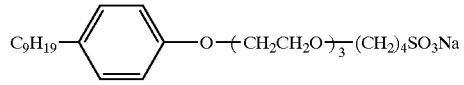

W-7 $C_{12}H_{25}O-(CH_2CH_2O)_{10}H$

W-8

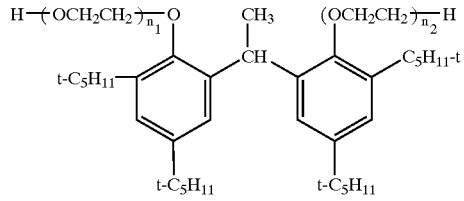

$n_1 + n_2 = 27$

W-9

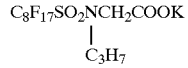

The amount of surfactant added is preferably 5 wt % or less of the total amount of binder, and more preferably 2 wt % or less. There is no particular restriction on the lower limit thereof, but it may be approximately 0.1 wt %.

The total amount of binder in the silver-supplying layer in the present invention is 0.2 to 30 g/m$^1$, and preferably in the range from 1 to 15 g/m$^2$. The total amount of binder in the photosensitive layer in the present invention is preferably in the range from 0.04 to 6 g/m$^2$, and more preferably from 0.2 to 3 g/m$^2$. Cross-linking agents for cross-linking, surfactants for improving the coating properties, etc. may be added to the silver-supplying layer and the photosensitive layer.

The total amount of binder (per layer) in the protective layer in the present invention is preferably in the range from 0.2 to 10 g/m$^2$, and more preferably from 1 to 5 g/m$^2$. A surfactant for improving the coating properties, etc. may be added to the protective layer. The pH of the protective layer coating liquid is preferably 5 to 8 for a lower layer and 2 to 7 for an upper layer.

In the present invention further addition of a fluorine-containing surfactant can provide good antistatic properties. With regard to the fluorine-containing surfactants which are preferably used in the present invention, there are surfactants with a fluoroalkyl group having 4 or more carbon atoms (normally 15 or less), a fluoroalkenyl group or a fluoroaryl group and as an ionic group an anionic group (sulfonic acid (salt), sulfuric acid (salt), carboxylic acid (salt), phosphoric acid (salt)), a cationic group (amine salt, ammonium salt, aromatic amine salt, sulfonium salt, phosphonium salt), a betaine (carboxyamine salt, carboxyammonium salt, sulfoamine salt, sulfoammonium salt, phosphoammonium salt) or a nonionic group (substituted or unsubstituted polyoxyalkylene, polyglyceryl or sorbitan).

These fluorine-containing surfactants are described in JP-A-49-10722, British Specification No.1,330,356, U.S. Pat. Nos. 4,335,201 and 4,347,308, British Specification No. 1,417,915, JP-A-55-149938, JP-A-58-196544, British Specification No.1,439,402, etc. Some detailed examples thereof are listed below.

F-1 $C_8F_{17}SO_3K$

F-2

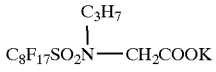

F-3

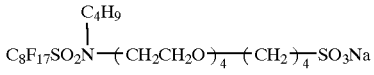

F-4

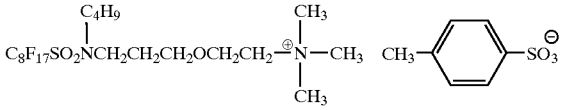

F-5 $C_8F_{17}SO_3Li$

The layer to which the fluorine-containing surfactant is added is not particularly limited as long as it is added to at least one layer of the image-recording material and, for example, a surface protective layer, photosensitive emulsion layer, silver-supplying layer, intermediate layer, undercoat layer, back layer, etc. can be cited. The surface protective layer is preferred thereamong, and either one on the image formation layer side or one on the back layer side may be chosen, but it is yet more preferred to add it to at least the surface protective layer on the image formation layer side.

In the case where the surface protective layer is formed from 2 or more layers, it may be added to any one thereof, and it is also possible to use it as an overcoat on top of the surface protective layer.

The amount of fluorine-containing surfactant may be 0.0001 to 1 g/m$^2$ of the image-recording material, preferably 0.0002 to 0.25 g/m$^2$, and particularly preferably 0.0003 to 0.1 g/m$^2$.

The fluorine-containing surfactant used in the present invention may be used in combinations of more than one type.

It is preferable to provide a moisture barrier or undercoat layer containing a vinylidene chloride copolymer on both sides of the support used in the present invention. The vinylidene chloride copolymer may be used singly or in combinations of more than one type. The vinylidene chloride copolymer undercoat layer has a total film thickness of at least 0.3 $\mu$m per face, and preferably in the range from 0.3 $\mu$m to 4 $\mu$m.

Such layers may contain cross-linking agents, matting agents, etc. in addition to the vinylidene chloride copolymer.

Various types of support can be used in the heat-developable image-recording material of the present invention. Typical supports include polyesters such as poly (ethylene terephthalate) and polyethylene naphthalate, cellulose nitrate, cellulose esters, polyvinyl acetals, polycarbonates, etc. Thereamong, biaxially stretched polyesters, in particular, poly(ethylene terephthalate) (PET), are preferred in terms of their strength, dimensional stability, chemical resistance, etc. The thickness of the support is preferably from 90 to 500 $\mu$m excluding the undercoat layers.

With regard to the support used in the heat-developable image-recording material of the present invention, a polyester, in particular poly(ethylene terephthalate), that has been subjected to a heat treatment at a temperature from 130 to 185° C. in order to relax the internal distortion remaining in the biaxially stretched film and prevent the occurrence of thermal shrinkage during heat development is preferred. The thermal relaxation treatment may be carried out at a constant temperature in the above temperature range or may be carried out while raising the temperature.

The support may be subjected to the heat treatment in a wound state or the treatment may be carried out while transporting it as a web. In the case where the treatment is carried while transporting it as a web, it is preferable for the transport tension applied to the support during heat treatment to be comparatively low and, specifically, 7 kg/cm$^2$ or less, and particularly preferably 4.2 kg/cm$^2$ or less. There is no particular lower limit to the transport tension in this case, but may be about 0.5 kg/cm$^2$.

Such a heat treatment is preferably carried out subsequent to a treatment to improve the adhesion of the image formation layer and the back layer to the support, the formation of the undercoat layer containing a vinylidene chloride copolymer, etc.

The percentage thermal shrinkage of the support due to a heat treatment at 120° C. for 30 seconds is preferably in the range from −0.03% to +0.01% in the machine direction (MD) and from 0 to 0.04% in the transverse direction (TD).

Undercoat layers comprising as a binder SBR, polyester, gelatin, etc. may be coated on the support as necessary in addition to a vinylidene chloride copolymer layer. The thickness (per layer) of the undercoat layer is normally from 0.01 to 5 $\mu$m, and preferably 0.05 to 1 $\mu$m.

Another preferred example of the support used in the present invention is an aluminum sheet. In the case of making a printing plate, in particular, an aluminum support is preferred. The thickness thereof is 0.1 to 1.0 mm, and the surface thereof is preferably subjected to an anodization treatment.

The image-recording material of the present invention can contain light absorbing substances and filter dyes described in U.S. Pat. Nos. 3,253,921, 2,274,782, 2,527,583 and 2,956,879. It is also possible to use mordanted dyes described in U.S. Pat. No. 3,282,699. The amount of filter dye used preferably gives an absorbance of 0.1 to 3 at the exposure light wavelength, and particularly preferably 0.2 to 1.5.

The photosensitive layer and silver-supplying layer may contain various types of dye or pigment so as to improve the color tone or prevent irradiation. Any dye or pigment may be used in the photosensitive layer, and examples thereof include the pigments and dyes listed in the Color Index. Specific examples thereof include organic pigments and inorganic pigments such as pyrazoloazole dyes, anthraquinone dyes, azo dyes, azomethine dyes, oxonol dyes, carbocyanine dyes, styryl dyes, triphenylmethane dyes, indoaniline dyes, indophenol dyes and phthalocyanines. Preferred examples of the dye used in the present invention include anthraquinone dyes (e.g. Compounds 1 to 9 described in JP-A-5-341441, Compounds 3-6 to 3-18 and 3-23 to 3-38 described in JP-A-5-165147), azomethine dyes (e.g. Compounds 17 to 47 described in JP-A-5-341441), indoaniline dyes (e.g. Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441). The dye may be added in the form of a solution, an emulsified product or a solid microparticle dispersion or may be added in a state in which it is mordanted with a polymer mordant, but it is preferable for water-soluble substances to be added as an aqueous solution thereof and for water-insoluble substances to be added as a solid microparticle dispersion thereof in water. The amount of such compounds used may be determined according to the desired absorbance, and, in general, the compounds are preferably used in an amount of from 1 $\mu$g to 1 g per m$^2$ of the heat-developable photosensitive material.

The optical density can be increased by the use of an additive which is known as a 'color toner' that improves the image quality. The addition of a color toner might also be advantageous when forming a black silver image. It is preferable for the color toner to be present in a layer on the side of the support having the photosensitive layer at 0.1 to 50 mol % per mol of silver, and more preferably 0.5 to 20 mol %. The color toner may be a so-called precursor that is derivatized so that it effectively functions only during development.

With regard to the heat-developable image-recording materials using an organic silver salt, many types of color toner are disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Specification No. 1,380,795, Belgian Patent No. 841,910, etc. Examples of the color toner are as follows; phthalimide and N-hydroxyphthalimide; succinimide, pyrazolin-5-one, and cyclic imides such as quinazolinone, 3-phenyl-2-pyrazolin-5-one, 1-phenylurazole, quinazoline and 2,4-thiazolidinedione; naphthalimides (e.g. N-hydroxy-1,8-naphthalimide); cobalt complexes (e.g. cobalt hexamine trifluoroacetate); mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryl dicarboxyimides (e.g. (N,N-dimethylaminomethyl)phthalimide and (N,N-dimethylaminomethyl) naphthalene-2,3-dicarboxyimide); blocked pyrazoles, isothiuronium derivatives and certain types of photobleaching agent (e.g. N,N-hexamethylenebis (1-carbamonyl-3,5-dimethylpyrazole), 1,8-(3,6-diazaoctane)bis(isothiuronium trifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidine dione; phthalazinone, phthalazinone derivatives or metal salts thereof, or derivatives such as 4-(1-naphthyl)phthalazinone, 6-chlorophthalazinone, 5,7-dimethoxyphthalazinone and 2,3-dihydro-1,4-phthalazine dione; combinations of phthalazinone and a phthalic acid derivative (e.g. phthalic acid, 4-methylphthalic acid, 4-nitrophthalic acid, tetrachloro phthalic anhydride, etc.); phthalazine, phthalazine derivatives (e.g. 4-(1-naphthyl) phthalazine, 6-chlorophthalazine, 5,7-dimethoxyphthalazine, iso-propylphthalazine, 6-iso-butylphthal azine, 6-tert-butyl phthalazine, 5,7-i methylphthalazine, 2,3-dihydrophthalazine, etc.) and metal salts thereof; combinations of phthalazine, a derivative thereof and a phthalic acid derivative (e.g. phthalic acid, 4-methylphthalic acid, 4-nitrophthalic acid, tetrachlorophthalic anhydride, etc.); quinazolinedione, benzoxazine or naphthoxazine derivatives; rhodium complexes that function not only as a color toner but also a halide ion source for the formation of a silver halide at the site such as, for example, ammonium hexachlororhodate (III), rhodium bromide, rhodium nitrate and potassium hexachlororhodate (III); inorganic peroxides and persulfates such as, for example, ammonium disulfide peroxide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidine and asymmetric triazines (e.g. 2,4-dihydroxypyrimidine, 2-hydroxy-4-aminopyrimidine, etc.); azauracyl, tetraazapentalene derivatives (e.g. 3,6-dimercapto-1,4-diphenyl-1H,4H-2,3a,5,6a-tetrazapentalene and 1,4-di(o-chlorophenyl)-3,6-dimercapto-1H,4H-2,3a,5,6a-tetraazapentalene), etc.

The color toner is preferably added as an aqueous solution thereof, but in the case where it is water-insoluble it may be added in any form such as a methanol solution thereof, a powder or a solid microparticle dispersion thereof. Dispersion of the solid microparticles is effected using a known pulverizing means (e.g. ball mill, vibrating ball mill, sand mill, colloid mill, jet mill or roller mill). A dispersion aid may be used for dispersing the solid microparticles.

A sensitizing dye may be used in the present invention. The sensitizing dye may be selected arbitrarily from those capable of spectrally sensitizing the silver halide grains in a desired wavelength region by adhering thereto. As such sensitizing dyes, usable examples are cyanine dyes, merocyanine dyes, cyanine complex dyes, merocyanine complex dyes, holopolar cyanine dyes, styryl dyes, hemicyanine dyes, oxonol dyes and hemioxonol dyes. Sensitizing dyes which are usable in the present invention are described, for example, in Research Disclosure, Item 17643, IV-A (December, 1978, p. 23), ibid. Item 1831X (August, 1979, p. 437) and also in the references cited therein. In particular, sensitizing dyes having a spectral sensitivity matched to the spectral characteristics of the light sources of various laser imagers, scanners, image setters, process cameras and the like can advantageously be selected.

Exemplary dyes advantageous for spectral sensitization to red light from the so-called red light sources such as He—Ne laser, red semiconductor laser and red LED, include Compounds I-1 to I-38 disclosed in JP-A-54-18726; Compounds I-1 to I-35 disclosed in JP-A-6-75322; Compounds I-1 to I-34 disclosed in JP-A-7-287338; Dyes 1 to 20 disclosed in JP-B-55-39818; Compounds I-1 to I-37 disclosed in JP-A-62-284343; and Compounds I-1 to I-34 disclosed in JP-A-7-287338.

Spectral sensitization to the wavelength region from 750 to 1,400 nm from semiconductor laser light sources can advantageously be obtained with various known dyes such as cyanine dyes, merocyanine dyes, styryl dyes, hemicyanine dyes, oxonol dyes, hemioxonol dyes and xanthene dyes. Useful cyanine dyes are those having a basic nucleus such as thiazoline, oxazoline, pyrroline, pyridine, oxazole, thiazole, selenazole or imidazole. Useful merocyanine dyes are those having the above-described basic nucleus or an acidic nucleus such as thiohydantoin, rhodanine, oxazolidinedione, thiazolinedione, barbituric acid, thiazolinone, malononitrile or pyrazolone. Of these cyanine and merocyanine dyes, those having an imino or a carboxyl group are particularly effective. The dye may be appropriately selected from known dyes described, for example, in U.S. Pat. Nos. 3,761,279, 3,719,495 and 3,877,943, British Specification No. 1,466,201, No. 1,469,117 and No. 1,422,057, JP-B-3-10391 and JP-B-6-52387, JP-A-5-341432, JP-A-6-194781 and JP-A-6-301141.

The dyes particularly preferably used for the present invention include cyanine dyes having a thioether bond (e.g. those described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-PTC-A-7-500926S, and U.S. Pat. No. 5,541,054); dyes having a carboxylic acid group (e.g. dyes disclosed in JP-A-3-163440, JP-A-6-301141, and U.S. Pat. No. 5,441,899); merocyanine dyes; polynuclear merocyanine dyes; and polynuclear cyanine dyes (those disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-W-A-55-50111, British Specification No. 1,467,638, and U.S. Pat. No. 5,281,515) and the like.

Dyes forming a J-band have been disclosed in U.S. Pat. Nos. 5,510,236 and 3,871,887 (Example 5), JP-A-2-96131 and JP-A-59-48753, and the like, and they can preferably be used for the present invention.

These sensitizing dyes may be used either individually or in combinations of two or more thereof. A combination of sensitizing dyes is often used for the purpose of supersensitization. In combination with the sensitizing dye, a dye which itself has no spectral sensitization effect, or a material which absorbs substantially no visible light but exhibits supersensitization may be incorporated into the emulsion. Useful sensitizing dyes, combinations of dyes which exhibit supersensitization, and materials which show supersensitization are described in Research Disclosure, Vol. 176, 17643, p. 23, Item IV-J (December, 1978), JP-B-49-25500 and JP-B-43-4933, JP-A-59-19032 and JP-A-59-192242, and the like.

The sensitizing dye may be added to the silver halide emulsion by dispersing it directly in the emulsion or it may be added to the emulsion after dissolving it in a solvent such as water, methanol, ethanol, propanol, acetone, methyl Cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide; these solvents being used singly or as mixtures.

The amount of sensitizing dye may be selected according to the requirements in terms of, for example, sensitivity or fogging performance, but it is preferably from $10^{-6}$ to 1 mol per mol of silver halide in the image formation layer (the photosensitive layer), and more preferably from $10^{-4}$ to $10^{-1}$ mol.

The silver halide emulsion and/or organic silver salt can be prevented, by the addition of an antifoggant, stabilizer or stabilizer precursor, from additional fogging and from lowered sensitivity during stock storage and can be thus stabilized. Appropriate examples of antifoggants, stabilizers and stabilizer precursors, available individually or in combination, include thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechols described in U.S. Pat. No. 3,235,652; oximes, nitrones and nitroindazoles described in British Specification No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogen substituted organic compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

The antifoggants which are preferably used in the present invention are halogen releasing precursors. An organic polyhalide having at least two halogen atom substituents on one carbon is particularly preferred. Typical compounds are disclosed in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-6-208193, JP-A-7-5621, JP-A-7-2781, JP-A-8-15809 and U.S. Pat. Nos. 5,340,712, 5,369,000 and 5,464,737. The halogen releasing precursors are used at $5\times10^{-5}$ to 0.5 mol/mol of silver of the organic silver salts, and preferably $2\times10^{-4}$ to $10^{-1}$ mol. Combinations of more than one type of halogen releasing precursor may be used. The halogen releasing precursor is preferably added to the silver-supplying layer or the photosensitive layer. It is particularly preferably added to the silver-supplying layer.

The antifoggants may be added in any form such as a solution, powder or solid microparticle dispersion, but it is preferable for a water-soluble substance to be added as an aqueous solution thereof and for a water-insoluble substance to be added as a solid microparticle dispersion thereof in water. The solid microparticle dispersion is effected using known pulverizing means (e.g. ball mill, vibrating ball mill, sand mill, colloid mill, jet mill or roller mill). Dispersion aids may be used for the solid microparticle dispersion.

The heat-developable image-recording material of the present invention may contain a benzoic acid for improving the sensitivity and for preventing fog. Any kind of benzoic acid derivative is suitable for the present invention, and preferred examples of the structure include those described in U.S. Pat. Nos. 4,784,939 and 4,152,160 and JP-A-9-329865, JP-A-9-329864 and JP-A-9-291637. Although the benzoic acid used in the present invention may be added to any part of the photosensitive material, addition to a layer provided on the same side as that of the image forming layer (the photosensitive layer) is preferable, and to an organic-silver-salt-containing layer is more preferable. The benzoic acid may be added at any stage during the preparation of the coating liquid. In the case of addition to the organic-silver-salt-containing layer, the benzoic acid may be added at any stage from the preparation of the organic silver salt to the preparation of the coating liquid, and addition following the preparation of the organic silver salt and immediately before the coating is preferable. The benzoic acid may be added as a solution, powder or solid microparticle dispersion. It is also allowable to add the benzoic acid in the form of a mixed solution containing other additives such as a sensitizing dye, reducing agent or color toner. The amount of benzoic acid added can be set arbitrarily, with a preferable range being from 1 $\mu$mol to 2 mol inclusive, per mol of silver, and more preferably from 1 mmol to 0.5 mol inclusive.

The heat-developable image-recording material of the present invention may contain a mercapto compound, a disulfide compound or a thione compound so as to control the development by inhibiting or accelerating it, to improve the spectral sensitization efficiency, or to improve the storage stability before and after development.

Although any mercapto compound structure is suitable in the present invention, these denoted by Ar—SM or Ar—S—S—Ar are preferable, wherein M represents hydrogen or an alkali metal atom; and Ar represents an aromatic ring or a fused aromatic ring containing one or more nitrogen, sulfur, oxygen, selenium or tellurium atoms. Preferable heteroaromatic rings therefor include benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g. Br and Cl)), hydroxyl, amino, carboxyl, alkyl (e.g. alkyl having at least one carbon atom, preferably from 1 to 4 carbon atoms), alkoxy (e.g. alkoxy having one or more carbon atoms, preferably from 1 to 4 carbon atoms) and aryl (which may also be substituted). Examples of the mercapto-substituted heteroaromatic compounds include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-benzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate; N-methyl-N'-[3-(5-mercaptotetrazolyl)phenyl]urea, 2-mercapto-4-phenyloxazole and 2-[3-(9-carbazolyl) propylimino]-3-(2-mercaptoethyl) benzothiazoline, while not particularly being limited thereto.

The amount of mercapto compound added to the photosensitive emulsion layer or silver-supplying layer is preferably from 0.0001 to 1.0 mol per mol of silver, and more preferably from 0.001 to 0.3 mol.

The image-recording material of the present invention can contain a polyhydric alcohol (e.g. the types of glycerine and diol described in U.S. Pat. No. 2,960,404), etc. as a plasticizer.

In the image-recording material of the present invention, a matting agent is desirably added to the surface protective layer in order to prevent malfunctions due to blocking when stacked. The matting agents are, in general, organic or inorganic microparticles insoluble in water. Any type of matting agent can be used, examples of which include organic matting agents disclosed in U.S. Pat. Nos. 1,939,213, 2,701,245, 2,322,037, 3,262,782, 3,539,344 and 3,767,448; and inorganic matting agents disclosed in U.S. Pat. Nos. 1,260,772, 2,192,241, 3,572,206, 3,370,951, 3,523,022 and 3,769,020, all being well known in the related art. More specifically, the organic compounds suitable as the matting agent include water-dispersible vinyl polymers such as polymethyl acrylate, polymethyl methacrylate, polyacrylonitrile, acrylonitrile-$\alpha$-methylstyrene copolymers, polystyrene, styrene-divinylbenzene copolymers, polyvinyl acetate, polyethylene carbonate and polytetrafluoroethylene; cellulose derivatives such as methylcellulose, cellulose acetate, and cellulose acetate propionate; starch derivatives such as carboxystarch, carboxynitrophenylstarch, and urea-formaldehyde-starch reaction products; gelatin hardened with a known hardening agent; and hardened gelatin in the form of fine encapsulated hollow particles obtained by coacervate hardening. Preferable examples of the inorganic compounds include silicon dioxide, titanium dioxide, magnesium dioxide, aluminum oxide, barium sulfate, calcium carbonate, silver chloride desensitized by a known method, silver bromide similarly processed, glass and diatomaceous earth. Different kinds of matting agent may be combined for use as required. The matting agents have the effect of preventing blocking problems by imparting unevenness to the surface of the protective layer so as to reduce the contact area. It is therefore preferred for the average particle size of the matting agent to be larger than the thickness of the protective layer, but this is not essential since a small particle size material may form aggregates and project from the surface. Those having a particle size of 1 μm or more are used in practice. When the particle size is too large, there is a high possibility that the matting agent might enter the image forming layer so preventing the formation of an image and forming pinholes. The particle size is therefore 10 μm or less in practice. Thus, the average particle size of the matting agent in the present invention is preferably from 1 μm to 10 μm. It is preferable for the particle size distribution of the matting agent to be narrow, and the degree of monodispersion is preferably 10% or less. The required average particle size, shape and particle size distribution can be achieved by mixing a plurality of matting agents when preparing the matting agent.

In the case where there is a plurality of protective layers, the effect of the addition of a matting agent can be obtained by adding it to any protective layer since the protective layer is generally thin, but it is preferably added it to the outermost surface layer or a layer which is as close to the external surface as possible.

The pH of the coating liquids for the photosensitive layer and the silver-supplying layer is adjusted so as to be between 5.5 and 7.8, and it is preferable to use an acid containing no halogen for the adjustment. The pH of the protective layer is low in comparison at 2 to 7, although it depends on the chemical that is added to the protective layer, and in the case where there is a plurality of protective layers it is preferable for the pH of the layers close to the image formation layer to be between 4 and 7 and for the pH of layers far therefrom to be between 2 and 5.

In the present invention, a release layer may be provided between the photosensitive layer and the silver-supplying layer. The release layer is a layer for promoting easy separation of the photosensitive layer from the silver-supplying layer after the formation of an image. With regard to the release layer, it is desirable to use a polymer binder having low compatibility with the binders in the adjoining layers, and cellulose derivatives such as cellulose esters or cellulose ethers, vinyl derivatives such as polyvinyl alcohols or partially saponified polyvinyl acetates, ethylene derivatives such as chlorinated polyethylene, etc. are preferred. The thickness of the layer may be from 0.05 to 5.0 μm, and is preferably from 0.1 to 2.0 μm.

In the case where a transparent support is used in the present invention, the back layer preferably has a maximum absorption in a desired wavelength region of from approximately 0.3 to 2.0. For a desired wavelength region of 750 to 1400 nm, the back layer is preferably an antihalation layer with an optical density within a wavelength region from 360 to 650 nm of from 0.005 to 0.5, and more preferably 0.001 to 0.3. For a desired wavelength region of 750 nm or shorter, the back layer is preferably an antihalation layer with a maximum optical density within such a desired wavelength region before image formation of 0.3 to 2.0, and with an optical density within a wavelength region from 360 to 650 nm after image formation of 0.005 to 0.3. There is no limitation on the method for lowering the optical density to the above-described range after image formation, and possible methods include that using the heat-assisted fading of dye color described in Belgian Pat. No. 733,706, and that involving decreasing the density by photoirradiation-assisted fading described in JP-A-54-17833.

In the case where an antihalation dye is used in the present invention, the dye may be any compound so long as the compound has a desired absorption in the desired wavelength region, the absorption in the visible wavelength region can be reduced sufficiently after processing, and the back layer can have a preferred form of absorption spectrum. While examples thereof include those described in the following Patent publications, the present invention is by no means limited thereto. As single dyes, the compounds described in JP-A-59-56458, JP-A-2-216140, JP-A-7-13295, JP-A-7-11432, U.S. Pat. No. 5,380,635, JP-A-2-68539 (from page 13, lower left column, line 1 to page 14, lower left column, line 9) and JP-A-3-24539 (from page 14, lower right column to page 16, lower right column); and as dyes which are faded after processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734 and U.S. Pat. Nos. 4,088,497, 4,283,487, 4,548,896 and 5,187,049 can be cited.

The binder preferably applied to the back layer in the present invention is transparent or semi-transparent, in general, colorless and can be made of a natural polymer, a synthetic resin, a polymer or a copolymer, as well as other film-forming media such as gelatin, gum arabic, poly(vinyl alcohol), hydroxyethylcellulose, cellulose acetate, cellulose acetate butyrate, poly(vinylpyrrolidone), casein, starch, poly (acrylic acid), poly(methyl methacrylate), poly(vinyl chloride), poly(methacrylic acid), copoly(styrene-maleic anhydride), copoly(styrene-acrylonitrile) copoly(styrene-butadiene), polyvinyl acetals (such as poly(vinyl formal) and poly(vinylbutyral)), polyesters, polyurethanes, phenoxy resins, poly (vinylidene chloride), polyepoxides, polycarbonates, poly(vinyl acetate), cellulose esters and polyamides. The binder may also be formed by coating from water, a solvent or an emulsion.

The total amount of binder used for the back layer is 0.01 to 10 g/m$^2$, and preferably 0.5 to 5 g/m$^2$.

In the present invention it is preferable to add a matting agent to the back layer in order to reduce the number of seconds measured in the Bekk smoothness test, and it is possible to adjust the Bekk smoothness so as to be from 2000 sec. to 10 sec, and more preferably 1500 sec. to 50 sec., by changing the particle size or the amount added. The Bekk smoothness can be determined in accordance with JIS P8119 and TAPPI T479.

It is preferable to add a lubricant to the outermost layer on the side having the image formation layer and/or the face opposite thereto.

The lubricants used in the present invention are not particularly limited and any compound can be used as long as it can reduce the coefficient of friction of the surface of a substance when it is present on the surface thereof in comparison with when it is absent from the surface thereof.

Representative examples of the lubricants used in the present invention include, for example, silicone type lubricants as in U.S. Pat. No. 3,042,522, British Specification No. 955,061, U.S. Pat. Nos. 3,080,317, 4,004,927, 4,047,958 and 3,489,567, British Specification No. 1,143,118, etc., higher fatty acid type, alcohol type and acid amide type lubricants as in U.S. Pat. Nos. 2,454,043, 2,732,305, 2,976,148 and 3,206,311, German Patent Nos 1,284,295 and 1,284,294, etc., metal soaps as in British Specification No. 1,263,722, U.S. Pat. No. 3,933,516, etc., ester type and ether type lubricants as in U.S. Pat. Nos. 2,588,765 and 3,121,060, British Specification No. 1,198,387, etc. taurine type lubricants as in U.S. Pat. Nos. 3,502,473 and 3,042,222, etc.

With regard to detailed examples of the lubricants preferably used in the present invention, there are Cellosol 524 (main ingredient is carnauba wax), Polylon A, 393, H-481 (main ingredient is polyethylene wax), Himicron G-110 (main ingredient is ethylene bis-stearamide), Himicron G-270 (main ingredient is stearamide) (all from Chukyo Oil & Fat), etc.

The amount of lubricant added is 0.1 to 50 wt % of the binder, and preferably 0.5 to 30 wt %.

The configuration of the heat-developable image-recording material of the present invention is now explained.

Preferred layer configurations of the present invention are as follows.

Configuration 1: The layers and the order in which they are superimposed on the support are as follows:

1) Photosensitive layer, 2) silver-supplying layer, 3) protective layer.

Configuration 2: The layers and the order in which they are superimposed on the support are as follows:

1) Silver-supplying layer, 2) photosensitive layer, 3) protective layer.

These layers may be coated in sequence or simultaneously as a multiple layer. In the case of configuration 1, the photosensitive layer can be embedded in the porous cavities of an anodized layer of an aluminum support. A photosensitive sheet in which photosensitive silver halide grains have been embedded in the anodized layer is commercially available as 'Fuji Film Alphoto Plate' (product name of Fuji Photo Film, Co., Ltd.), and the technique for introducing silver halide grains into an anodized layer is known. In this case, it is desirable that after silver halide grains have been introduced into the anodized layer, the remaining layers are applied simultaneously.

The formation of an image in the present invention is carried out in the following steps.

a. Imagewise exposure: Area exposure by means of a camera or scanning exposure by means of a laser beam.
b. Heat development: The entire recording material or the surface on the photosensitive layer side is heated so that the development reaction proceeds and a silver image is formed in the silver-supplying layer.

In the present invention, layers such as the image-forming layer and back layer may each contain a hardening agent. Examples of the hardening agent include polyisocyanates described in U.S. Pat. No. 4,281,060 and JP-A-6-208193; epoxy compounds described, for example, in U.S. Pat. No. 4,791,042; and vinyl sulfone-based compounds described, for example, in JP-A-62-89048.

Surfactants may be used in the present invention in order to improve the coating properties, etc. Nonionic, anionic, fluorine-containing, and any other type of surfactant are suitable. More specifically, they are exemplified by fluorine-containing polymer surfactants disclosed, for example, in JP-A-62-170950 and U.S. Pat. No. 5,380,644; fluorine-containing surfactants disclosed, for example, in JP-A-60-244945 and JP-A-63-188135; polysiloxane-based surfactants disclosed, for example, in U.S. Pat. No. 3,885,965; polyalkyleneoxide surfactants disclosed, for example, in JP-A-6-301140; and anionic surfactants.

The heat-developable photosensitive emulsion in the present invention may be coated by a variety of coating processes, which include dip coating, air knife coating, flow coating, and extrusion coating using a specific hopper described in U.S. Pat. No. 2,681,294. It is also allowable to coat two or more layers as required according to the methods described in U.S. Pat. No. 2,761,791 and British Specification No. 837,095.

The heat-developable image-recording material of the present invention may be developed by any method, and in general the development is performed by elevating the temperature of the image-recording material after imagewise exposure. Preferred embodiments of the heat-developing apparatus used include those in which the heat-developable image-recording material is placed in contact with a heat source such as a heat roller or heat drum described in JP-B-5-56499, Japanese Patent No.684453, JP-A-9-292695, JP-A-9-297385 and WO95/30934; and those of a non-contacting type described in JP-A-7-13294 and WO97/28489, WO97/28488 and WO97/28487. Of these, the non-contacting type heat-developing apparatus is particularly preferred. The development temperature is preferably from 80 to 250° C., and more preferably from 100 to 140° C. The development time is preferably from 1 to 180 seconds, and more preferably from 10 to 90 seconds.

For preventing uneven processing and physical distortion due to dimensional changes in the heat-developable image-recording material of the present invention during heat development, it is preferable to heat the material at a temperature of from 80° C. to 115° C. (preferably 113° C. or less) for 5 seconds or more so as to prevent the image from appearing, and then develop the material by heating at a temperature of 110° C. or above (preferably 130° C. or less) to produce the image (the so-called multi-stage heating method).

Gradual cooling after the heat development is preferable. The speed of cooling from the development temperature to 70° C. is 200° C./min. or less, and preferably 150 to 50° C./min.

The image-recording material of the present invention may be exposed by any method, but it is preferable to use a laser beam as the light source for exposure. With regard to the laser beams used in the present invention, gas lasers, YAG lasers, dye lasers, semiconductor lasers, etc. are preferred. It is also possible to use a semiconductor laser and a second harmonic generation device, etc.

The image-recording material of the present invention has a low haze during exposure and is liable to suffer from the generation of interference fringes. With regard to techniques to prevent the generation of interference fringes, a technique disclosed in JP-A-5-113548, etc. in which a laser beam enters the image-recording material obliquely and a method disclosed in WO95/31754, etc. in which a multimode laser is used are known, and it is desirable to employ these techniques.

When the image-recording material of the present invention is exposed, as disclosed in SPIE Vol.169, "Laser Printing" pp.116 to 128 (1979), JP-A-4-51043, WO95/31754, etc., it is preferable for the laser beam to be applied in an overlapping manner, so hiding the scanning lines.

The present invention will be explained in more detail with reference to the following examples. However, the present invention is not limited thereto.

EXAMPLES

Firstly, the materials used in the examples are explained.

<Preparation of Support by Forming a Back Layer, Followed by Heating>

The following layers were provided on a PET base having a thickness of 250 μm.

(Coating of Undercoat Layers)

The following undercoat layers (a) and (b) were coated on one side of the PET base, and each was dried at 180° C. for 4 minutes.

Undercoat layer (a)

Polymer Latex V-5

(a latex of the core-shell type comprising 90 wt % of core and 10 wt % of shell; core comprising vinylidene chloride/methyl acrylate/methyl methacrylate/acrylonitrile/acrylic acid=93/3/3/0.9/0.1 (wt %), shell comprising vinylidene chloride/methyl acrylate methyl methacrylate/acrylonitrile/acrylic acid=88/3/3/3/3 (wt %), weight average molecular weight 38,000)

| | |
|---|---|
| Solid portion | 3.0 g/m$^2$ |
| 2,4-Dichloro-6-hydroxy-s-triazine | 23 mg/m$^2$ |
| Matting agent (polystyrene, average particle size 2.4 μm) | 1.5 mg/m$^2$ |
| Undercoat (b) | |
| Alkali treated gelatin ($Ca^{2+}$ content 30 ppm, gel strength 230 g) | 83 mg/m$^2$ |
| Compound A | 1 mg/m$^2$ |
| Compound H | 2 mg/m$^2$ |
| Methyl cellulose | 4 mg/m$^2$ |
| Compound I | 3 mg/m$^2$ |
| (Coating of Back Layer) | |
| The following back layers were provided on the other side of the PET base. | |
| First Back Layer | |
| Jurimer ET-410 (Nippon Junyaku KK) | 38 mg/m$^2$ |
| $SnO_2$/Sb (9/1 by weight, acicular microparticles, made by Ishihara Sangyo Ltd., product name FS-10D) | 200 g/m$^2$ |
| Dye A | 20 mg/m$^2$ |
| Matting agent (polymethylmethacrylate microparticles, average particle size 5 μm) | 10 mg/m$^2$ |
| Crosslinking agent (Denacol EX-614B, made by Nagase Chemicals Ltd.) | 13 mg/m$^2$ |
| Second Back Layer | |
| Latex binder (Chemipearl S-120, made by Mitsui Chemical Co., Ltd.) | 500 mg/m$^2$ |
| Colloidal silica (Snowtex-C, made by Nissan Chemical Industries, Ltd.) | 40 mg/m$^2$ |
| Crosslinking agent (Denacol EX-614B, made by Nagase Chemicals Ltd.) | 30 mg/m$^2$ |

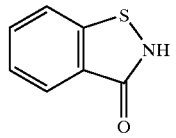

Compound A

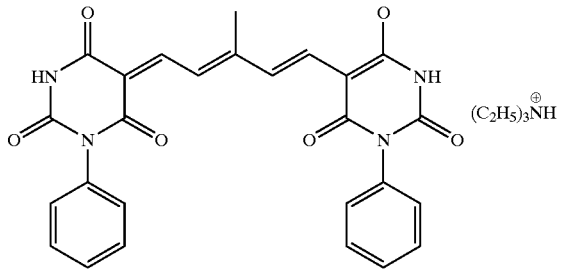

Dye A

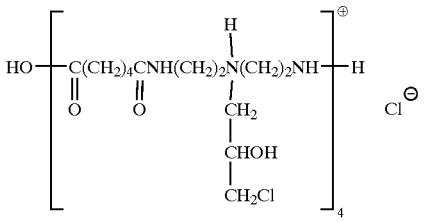

Compound H $C_{12}H_{25}O(CH_2CH_2O)_{10}H$

Compound 1

The two back layers were coated successively and each was dried at 180° C. for 4 minutes.

(Annealing of Support)

After the undercoat layers and back layers had been coated and dried, a first annealing was performed under a tension of 5 kg/cm$^2$ at 130° C. for 10 minutes, which was followed by a second annealing under a tension of 10 kg/cm$^2$ at 40° C. for 15 seconds.

<Preparation of Photosensitive Silver Halide Emulsion>

11 g of phthalated gelatin, 30 mg of potassium bromide and 10 mg of sodium thiosulfonate were dissolved in 700 ml of water, and after conditioning at pH 5.0 and 35° C., 159 ml of an aqueous solution containing 18.6 g of silver nitrate and an aqueous solution containing 1 mol/l of potassium bromide were added by the controlled double jet method over 6.5 minutes while keeping the pAg at 7.7. Subsequently, 476 ml of an aqueous solution containing 55.4 g of silver nitrate and an aqueous solution containing 1 mol/l of potassium bromide were added by the controlled double jet method over 30 minutes while keeping the pAg at 7.7. 1 g of 4-hydroxy-6-methyl-1,3,3a,7-tetrazaindene was then added to the mixture, and the pH was lowered to cause coagulation precipitation and thereby effect desalting. 0.1 g of phenoxyethanol was then added followed by conditioning at pH 5.9 and pAg 8.2 to produce silver bromide grains (cubic grains having an average grain size of 0.12 μm, a coefficient of variation of the projected area of 8% and a (100) plane ratio of 88%).

The silver bromide so obtained was heated to 60° C., $8.5\times10^{-4}$ mol/mol Ag of sodium thiosulfonate was added thereto, it was ripened for 120 minutes and rapidly cooled to 40° C., $1\times10^{-5}$ mol of Sensitizing Dye A, $5\times10^{-5}$ mol of Compound B, $5\times10^{-5}$ mol of N-methyl-N'-{3-(mercaptotetrazolyl)phenyl}urea and 100 ppm of Compound A were added thereto and it was rapidly cooled to 30° C. to give a silver halide emulsion.

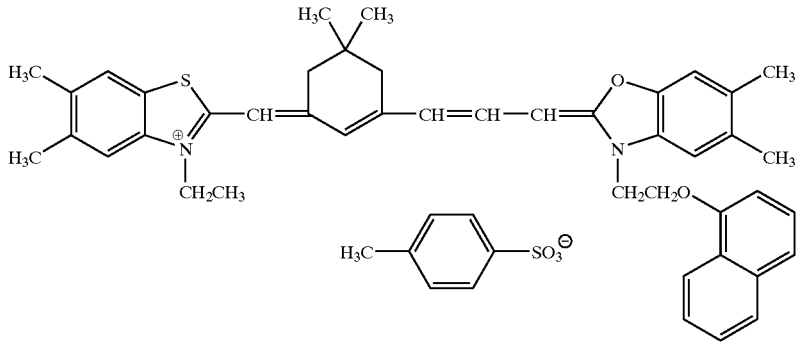

Sensitizing Dye A

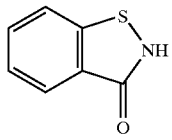

Compound A

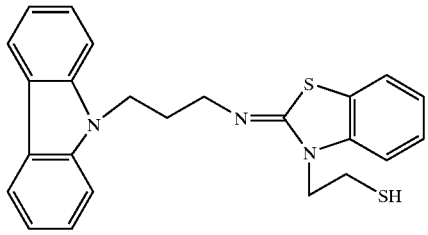

Compound B

<Preparation of Organic Acid Silver Salt Dispersion A>

103 ml of a 1N aqueous NaOH solution was added to a mixture of 4.4 g of stearic acid, 39.4 g of behenic acid and 770 ml of distilled water while stirring at 90° C., the mixture was allowed to react for 240 minutes, and then cooled to 75° C. Subsequently, 112.5 ml of an aqueous solution containing 19.2 g of silver nitrate was added to the mixture over 45 seconds, the mixture was allowed to stand for 20 minutes, and then cooled to 30° C. The solid content was then separated by suction filtration, and washed with water until the conductivity of the filtrate became 30 $\mu$S/cm. The solid content so obtained was added to 100 ml of a 10 wt % aqueous polyvinylalcohol solution, and water was further added thereto so as to adjust the total weight to 270 g. The resulting mixture was roughly dispersed using an automatic mortar, and then thoroughly dispersed using a "Nanomizer" dispersion apparatus (trade name, made by Nanomizer, Ltd.) under an impingement pressure of 1000 kg/cm$^2$ to obtain a dispersion of acicular particles with an average short axis length of 0.04 $\mu$m, an average long axis length of 0.8 $\mu$m and a variance coefficient of 30%.

<Preparation of Reducing Agent Dispersion>

250 g of 1,1-bis(2-hydroxy-3,5-dimethylphenyl)-3,5,5-trimethylhexane and 125 g of polyvinylalcohol were added to 600 g of water and then mixed thoroughly to prepare a slurry. The slurry was then put into the vessel of a sandmill (1/4G Sand Grinder Mill, made by of Aimex Ltd.) together with 840 g of dispersion beads (zirconia grains with an average diameter of 0.5 mm), and dispersed for 5 hours to obtain a reducing agent dispersion with an average particle size of 0.5 $\mu$m.

<Preparation of Solubilized Solution A of a Phthalazine Derivative>

A solubilized solution A of a phthalazine derivative A was prepared by mixing and stirring the following components at the ratios below.

| Solubilized solution A | |
|---|---|
| Phthalazine Derivative A | 25 g |
| Leopol BX (product name; made by Takemoto Yushi, sodium triisopropylnaphthalensulfonate) | 2.1 g |
| Polyvinyl alcohol (PVA-217 from Kuraray Co., Ltd, 20% aqueous solution) | 100 g |
| Water | 373 g |

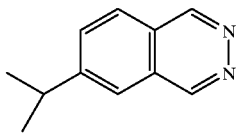

<Preparation of Electron Transfer Agent Dispersion>

10 g of an electron transfer agent N-1, 2.5 g of Kuraray Co., Ltd Poval #217 (brand name; made by Kuraray Co., Ltd) and 87.5 g of water were mixed and dispersed using zirconia beads in the same manner as that used for the above-mentioned reducing agent to give a dispersion having an average particle size of 0.3 um.

<Preparation of Solid Microparticle Dispersion of Organic Polyhalogen Compound>

0.5 g of hydroxypropyl methyl cellulose, 0.5 g of Compound C and 88.5 g of water were added to 30 g of organic polyhalogen compound A, they were mixed well to give a slurry, which was allowed to stand for 3 hours.

Subsequently, a solid microparticle dispersion was prepared in the same manner as that used for the preparation of the reducing agent solid microparticle dispersion. 80 wt % of the particles had a particle size in the range from 0.3 μm to 1.0 μm.

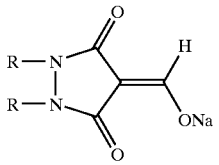

R = (n)$C_{12}H_{25}$—

Electron Trasfer Agent N-1

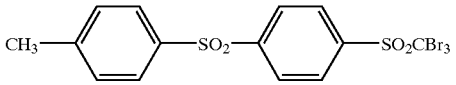

Organic Polyhalogen Compound A

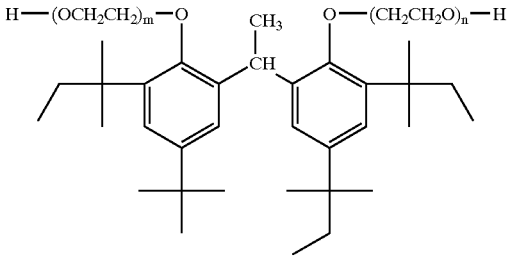

m + n = 27

Compound C

Example 1

The following silver-supplying layer, photosensitive layer and protective layer were simultaneously coated on the side coated with the undercoat layers (a) and (b) of the PET support coated with the aforementioned back/undercoat layers.

(Preparation and Coating of Silver-Supplying Layer)

85 g of the above-mentioned organic acid silver salt dispersion, 29 g of the reducing agent dispersion, 46 g of Lacstar #3307B (made by Dainippon Ink & Chemicals, Inc., SBR Latex; Tg 13° C., 49 wt %), 6 g of 10 wt % Kuraray Co., Ltd Poval MP-203, 13 g of the solubilized solution A of the phthalazine derivative, 10 g of the organic polyhalide dispersion, 7.4 g of the above-mentioned electron transfer agent dispersion, 0.07 g of 5-methylbenzotriazole, 6 mg of Dye A and 25 g of water were mixed well. The mixture was coated so that the amount of silver coated was 1.0 g/$m^2$.

(Preparation and Coating of Photosensitive Layer Coating Liquid)

33 g of the photosensitive silver halide emulsion A, 47 g of the reducing agent dispersion, 23 g of Lacstar #3307B (made by Dainippon Ink & Chemicals, Inc., SBR Latex; Tg 13° C., 49 wt %), 10 g of 10 wt % Kuraray Co., Ltd Poval MP-203, 0.03 g of 5-methylbenzotriazole, 12 mg of Dye A and 10 g of water were mixed well. The mixture was coated so that the amount of silver coated was 0.15 g/$m^2$.

(Preparation and Coating of Protective Layer)

3.75 g of water was added to 109 g of a 27.5% solids polymer latex (copolymer of methyl methacrylate/styrene/2-ethylhexyl acrylate/2-hydroxyethyl methacrylate/methacrylic acid=59/9/26/5/1, Tg 55° C.), 4.5 g of benzyl alcohol as a film formation aid, 0.45 g of Compound 2, 0.125 g of Compound 3, 0.0125 mol of Compound 4 and 2.25 g of polyvinyl alcohol (Kuraray Co., Ltd, PVA-217) were added thereto, and water was further added so as to make the total weight 150 g to give a coating liquid. It was coated on the photosensitive layer so that the amount of polymer latex coated was 2.0 g/$m^2$

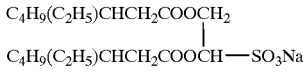

Compound 2

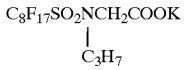

Compound 3

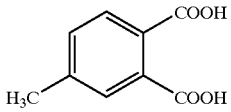

Compound 4

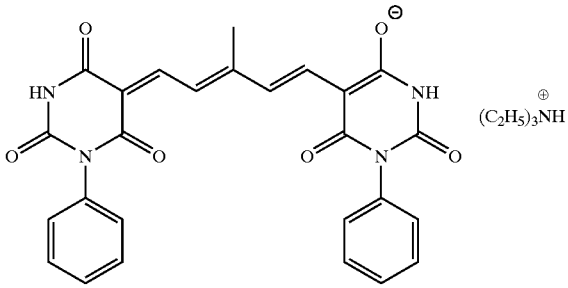

Dye A

The three layers were simultaneously coated and dried at 60° C. for 2 minutes. The sample so obtained was designated as Sample 1.

<Preparation of Comparative Sample A>

(Preparation and Coating of Photosensitive Organic Acid Silver Salt Layer Coating Liquid)

The photosensitive layer and the silver-supplying layer of Sample 1 of the present invention were not employed and, instead, the following organic acid silver salt coating liquid containing a photosensitive silver halide was prepared and coated.

100 g of the above-mentioned organic acid silver salt dispersion, 10 g of the reducing agent dispersion, 40 g of Lacstar #3307B (made by Dainippon Ink & Chemicals, Inc., SBR Latex; Tg 13° C., 49 wt %), 40 g of 10 wt % Kuraray Poval MP-203, 20 g of the silver halide emulsion A, 10 g of the solubilized solution A of the phthalazine derivative, 5 g of the organic polyhalide dispersion, 8.7 g of the dispersion of the electron transfer agent N-1, 0.01 g of 5-methylbenzotriazole, 2 mg of sodium dihydrogenphosphate, 6 mg of Dye A and 100 g of water were mixed well. The mixture was coated so that the amount of silver coated was 1.5 g/m$^2$.

The protective layer and the photosensitive organic acid silver salt layer were simultaneously coated and dried at 60° C. for 2 minutes. This was designated as Comparative Sample A. That is to say, Comparative Sample A contained the conventional silver halide and the organic acid silver salt in the same layer.

<Preparation of Comparative Sample B>

Comparative Sample B was prepared in the same manner as that used for Sample 1 of the present invention except that the electron transfer agent was removed from the silver-supplying layer. That is to say, Comparative Sample B comprised separately a photosensitive layer containing a silver halide and a non-photosensitive silver-supplying layer containing an organic acid silver salt and no silver halide, and contained no electron transfer agent.

<Examination of Features of the Silver Image>

Sample 1 of the present invention and Comparative Samples A and B were exposed to xenon flashlight radiation for a period of $10^{-6}$ sec. through an interference filter having a peak at 780 nm and a step wedge having density differences of 0.1 and subjected to heat development at 119° C. for 20 to 40 seconds. The fog density of the unexposed area and the maximum density $D_{MAX}$ of the exposed area of each of the samples were measured. Sample 1 of the present invention formed a stable image in 40 seconds, the optical density of the unexposed area was 0.12 and the $D_{MAX}$ was 2.77. Comparative Sample A formed a stable image in 20 seconds, the optical density of the unexposed area was 0.14 and the $D_{MAX}$ was 3.01 and similar to Sample 1. Comparative Sample B formed hardly any image after 40 seconds of development, and the optical densities of both unexposed and exposed areas were 0.12. The formation of stable images on exposed areas was indicated by the time interval over which the image density of the exposed area increased while the fog density of the unexposed area did not increase.

Figure 2:
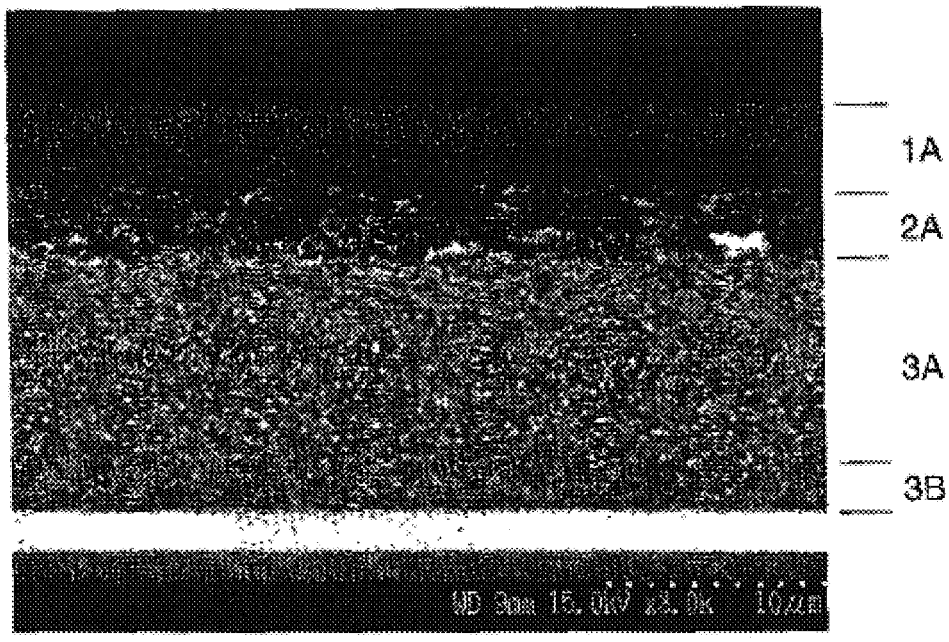
FIG. 2 is a scanning electron micrograph of a cross section of a heat-developable image-recording material related to one embodiment of the present invention after heat development at a magnification of 3000 times.
Figure 3:
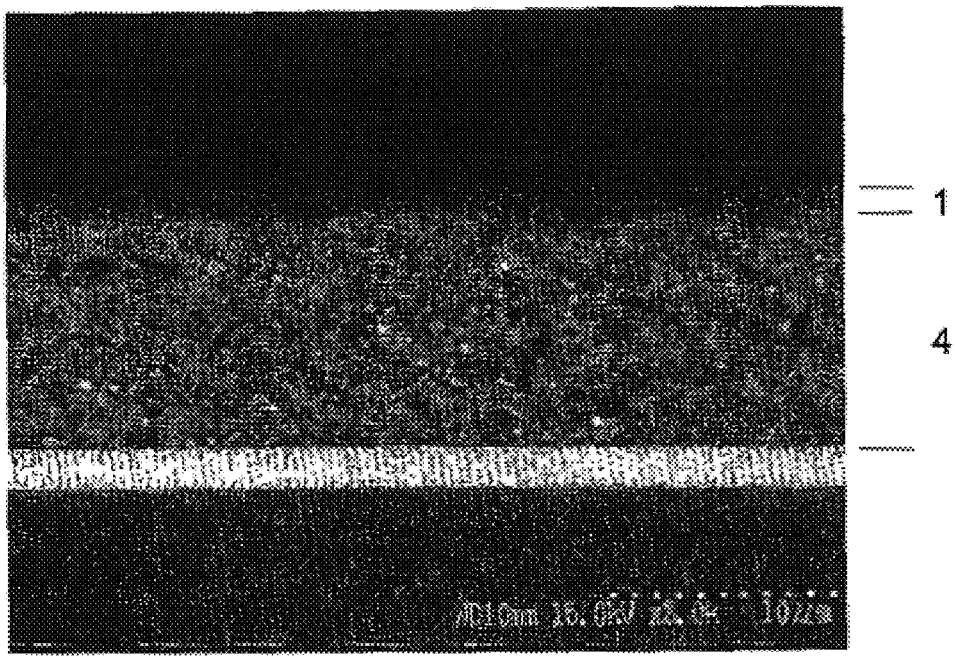
FIG. 3 is a scanning electron micrograph of a cross section of a sample of a comparative heat-developable image-recording material before heat development at a magnification of 3000 times.
Figure 4:
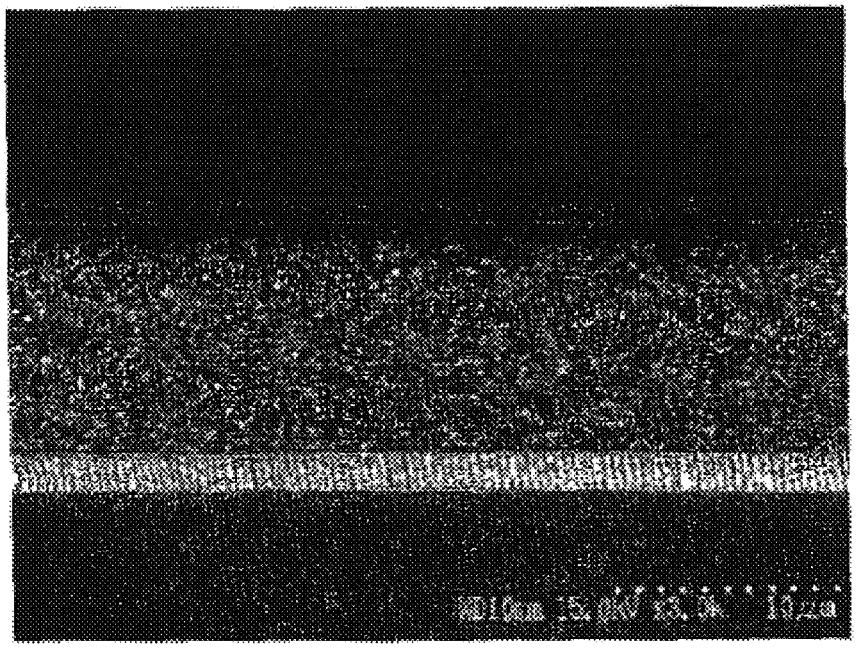
FIG. 4 is a scanning electron micrograph of a cross section of a sample of a comparative heat-developable image-recording material after heat development at a magnification of 3000 times.

Cross sections of the images of Sample 1 and Comparative Sample A were examined by a scanning electron microscope. FIG. 1 and FIG. 2 show photographs of a cross section of the sample of the present invention before and after heat development, and FIG. 3 and FIG. 4 show photographs of a cross section of Comparative Sample A before and after heat development. The magnification was 3000 times for all the photographs. As is clear from the photographs, in the sample of the present invention an image was slightly developed in the photosensitive layer and a silver image was formed in the silver-supplying layer thereunder. On the other hand, in Comparative Sample A a silver image was formed throughout the entire organic acid silver salt layer. Although photographs are not attached, when photographs of cross sections of Sample 1 of the present invention after 20 seconds and 30 seconds of development were examined, it was found that when the development time was short only an area close to the photosensitive layer was developed, and as the development time increased the developed area gradually spread to the inner layer.

<Comparison of Other Photographic Performance Characteristics>

Changes in the photographic performance characteristics including the photographic sensitivity were examined during storage of Sample 1 and Comparative Sample A at high temperature and high humidity. Heat development was carried out under the optimal conditions for each of the samples. The accelerated storage conditions were 50° C. and 40%RH for 3 days and 50° C. and 75%RH for 3 days. The sensitivity S (0.3) is expressed as the inverse logarithm of the exposure that gave a density of 0.3 and is a relative value using the value for Comparative Sample A as a reference. The gradation G is expressed as the gradient of a line between the point at which the density on the characteristic curve is 0.5 and the point at which the density is 1.5.

The results are given in Table 1.

TABLE 1

| Sample name | Storage Conditions | Fog | S (0.3) | G |
|---|---|---|---|---|
| Sample 1 | Initial value | 0.12 | +0.25 | 15.3 |
| | 50° C., 40% RH, 3 days | 0.12 | +0.25 | 15.7 |
| | 50° C., 75% RH, 3 days | 0.14 | +0.29 | 17.2 |
| Comparative Sample A | Initial value | 0.14 | ±0 (Reference) | 17.1 |
| | 50° C., 40% RH, 3 days | 0.18 | +0.02 | 16.6 |
| | 50° C., 75% RH, 3 days | 0.33 | −0.14 | 12.8 |

It is clear from the results shown in Table 1 that the sample of the present invention had the following outstanding effects:

1) Its initial sensitivity of 0.25 was about 1.8 times that of the comparative sample;
2) the initial fog was low;
3) the increase in fog when stored under the accelerated conditions was small; and
4) the change after storage at 50° C. and 75%RH for 3 days was small although the sensitivity of the comparative sample decreased and the gradation thereof became blurred.

As hereinbefore described, in accordance with the configuration of the present invention, the silver image is formed by heat development in a location completely different from that of the conventional configuration and, furthermore, the photographic performance characteristics can be enhanced and the storage stability can be increased.

Example 2

Samples 2 to 6 were prepared by the same procedure as in Example 1 except that electron transfer agents N-2 to N-6 were used instead of N-1. When the samples were evaluated in the same manner as in Example 1, the effects of the present invention were obtained as in Example 1.

N-2

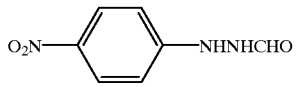

N-3

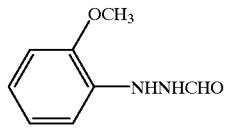

-continued

N-4

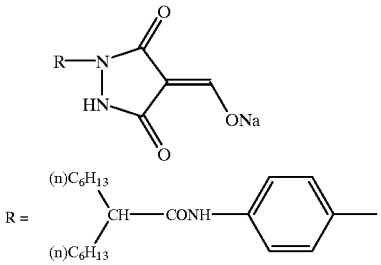

N-5

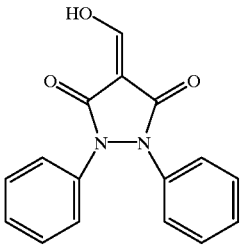

N-6

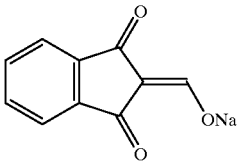

Example 3

The procedure of Example 1 was repeated except that 10% of the amount of electron transfer agent N-1 was added to the photosensitive layer and 90% thereof was added to the silver-supplying layer. The same performance characteristics as in Example 1 were obtained.

Example 4

(Preparation of Support having a Back Layer)

6 g of polyvinyl butyral (Denki Kagaku Kogyo K.K., Denka Butyral #4000-2), 0.2 g of Sildex H121 (Toukai Kagaku, spherical silica of average particle size 12 $\mu$m), 0.2 g of Sildex H51 (Toukai Kagaku, spherical silica of average particle size 5 $\mu$m) and 0.1 g of Megafax F-176P were added, dissolved and mixed in 64 g of 2-propanol while stirring. A solution of 420 mg of Dye A in a mixture of 10 g of methanol and 20 g of acetone and a solution of 0.8 g of 3-isocyanatomethyl-3,5,5-trimethylhexyl isocyanate in 6 g of ethyl acetate were further added to the above mixture to give a coating liquid.

The back layer coating liquid was coated on a 250 $\mu$m thick poly(ethylene terephthalate) film which had moisture resistant undercoat layers containing vinylidene chloride on both sides so that the optical density at 780 nm became 0.7.

The following photosensitive layer, silver-supplying layer and protective layer were coated in succession on the support so obtained.

(Preparation of Silver Halide Grains B)

7.5 g of inert gelatin and 10 mg of potassium bromide were dissolved in 900 ml of water, the pH was adjusted to 3.5 at 35° C., and 370 ml of an aqueous solution containing 74 g of silver nitrate and an aqueous solution containing potassium bromide and potassium iodide at a molar ratio of 94:6 and $K_8[IrCl_6]$ were added thereto over 10 minutes by the controlled double jet method while maintaining the pAg at 7.7. The $[IrCl_6]^{-3}$ was added at $3\times10^{-7}$ mol per mol of silver. Subsequently, 0.3 g of 4-hydroxy-6-methyl-1,3,3a,7-tetrazaindene was added thereto, and the pH was adjusted to 5 with NaOH to give cubic silver iodide bromide grains having an average size of 0.06 km, a variance coefficient of the projected area of 8% and a [110] plane proportion of 87%. This emulsion was aggregated and precipitated using a gelatin aggregating agent and desalted, 0.1 g of phenoxyethanol was then added thereto, and the pH and pAg were adjusted to 5.9 and 7.5 respectively.

(Preparation of Organic Acid Silver Salt Emulsion B)

10.6 g of behenic acid and 300 ml of distilled water were mixed at 90° C. for 15 minutes, 31.1 ml of a 1N aqueous solution of NaOH was added thereto over 15 minutes while vigorously stirring, the mixture was allowed to stand for 1 hour, and the temperature was then decreased to 30° C. 7 ml of a 1N aqueous solution of phosphoric acid was added, 0.13 g of N-bromosuccinimide (C-2) was added thereto while stirring more vigorously, and the previously prepared silver halide grains A were then added thereto so that the amount of silver halide became 2.5 moles. 25 ml of a 1N aqueous solution of silver nitrate was further added thereto continuously over 2 minutes, and the mixture was stirred as it was for 90 minutes. 37 g of a 1.2 wt % butyl acetate solution of polyvinyl acetate was added to the aqueous mixture above so as to form a floc dispersion, the water was then removed, the residue was washed with water twice and the water was removed, 20 g of a 2.5 wt % solution of polyvinyl butyral (Denki Kagaku Kogyo K.K., Denka Butyral #3000-K) in a mixture of butyl acetate and isopropyl alcohol at 1:2 was added while stirring, subsequently 7.8 g of polyvinyl butyral (Denki Kagaku Kogyo, Denka Butyral #4000-2) and 57 g of 2-butanone were added to the gel mixture of organic acid and silver halide so obtained and dispersed by a homogenizer to give a silver behenate emulsion (acicular particles having an average short diameter of 0.04 lam, an average long diameter of 1 $\mu$m and a variance coefficient of 30%).

(Coating of Silver-Supplying Layer)

The following chemicals were added to the organic acid silver salt emulsion B obtained above at the amounts below per mol of silver. 10 mg of sodium phenylthiosulfonate, 21.5 g of 4-chlorobenzophenone-2-carboxylic acid (C-3), 580 g of 2-butanone and 220 g of dimethyl formamide were added at 25° C. while stirring and the mixture was allowed to stand for 3 hours. 4 g of 4,6-di(trichloromethyl)-2-phenyltriazine (C-4),170 g of 1,1-bis(2-hydroxy-3,5-dimethylphenyl)-3,5,5-trimethylhexane (C-5), 5 g of tetrachlorophthalic acid (C-7), 15 g of phthalazine (C-6), 0.6 g of the electron transfer agent N-8, 1.1 g of Megafax F-176P (made by Dainippon Ink & Chemicals, Inc., fluorine type surfactant), 590 g of 2-utanone and 10 g of methyl isobutyl ketone were then added thereto while stirring. The coating liquid so obtained was coated so that the amount of silver coated was 0.5 g/m$^2$ and dried.

(Coating of Photosensitive Layer)

The following chemicals were added to the organic acid silver salt emulsion B obtained above at the amounts below per mol of silver. 10 mg of sodium phenylthiosulfonate, 25 mg of Sensitizing Dye A, 20 mg of Sensitizing Dye B, 18 mg of Sensitizing Dye C, 2 g of 2-mercapto-5-methylbenzimidazole (C-1), 580 g of 2-butanone and 220 g of dimethyl formamide were added at 25° C. while stirring and allowed to stand for 3 hours. 170 g of 1,1-bis(2-hydroxy-3,5-dimethylphenyl)-3,5,5-trimethylhexane (C-5), 1.1 g of Megafax F-176P (made by Dainippon Ink & Chemicals, Inc., fluorine type surfactant), 590 g of 2-butanone and 10 g of methyl isobutyl ketone were then added thereto while stirring. The coating liquid so obtained was coated so that the amount of silver coated was 0.10 g/m$^2$ and dried.

(Coating of Emulsion Surface Protective Layer)

75 g of CAB 171-15S (made by Eastman Chemical, cellulose acetate butyrate), 5.7 g of 4-methylphthalic acid (C-8), 1.5 g of tetrachlorophthalic anhydride (C-9), 8 g of tribromomethylsulfonylbenzene (C-12), 6 g of 2-tribromomethylsulfonylbenzothiazole (C-10), 3 g of phthalazone (C-11), 0.3 g of Megafax F-176P, 2 g of Sildex H31 (Toukai Kagaku, spherical silica of average particle size 3 $\mu$m) and 6 g of Sumidur N3500 (made by Sumitomo Bayer Urethane, polyisocyanate) were dissolved in 3070 g of 2-butanone and 30 g of ethyl acetate. The coating liquid so obtained was coated to give a CAB 171-15S thickness of 3 $\mu$m and dried.

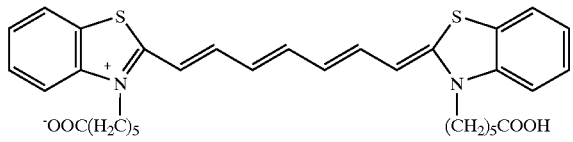

Sensitizing Dye (A)

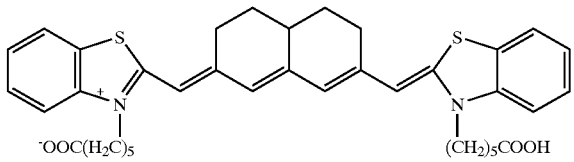

Sensitizing Dye (B)

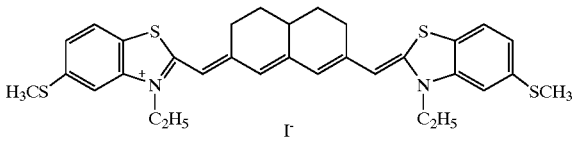

Sensitizing Dye (C)

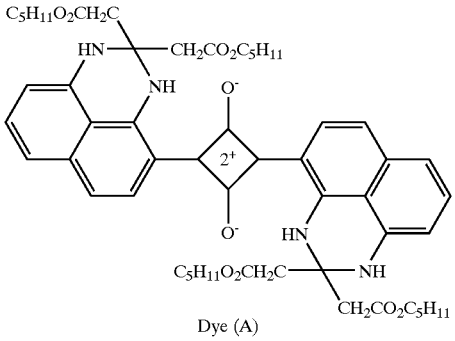

Dye (A)

(Exposure and Development)

Exposure was carried out using xenon flashlight radiation for a period of $10^{-4}$ sec. through an interference filter having a peak at 780 nm and a step wedge and treated (developed) at 117° C. for 25 seconds. A heat-developable image-recording material having a fog of 0.09 and a gradation G of 13.8 and storage stability as good as that of Sample 1 was obtained.

What is claimed is:

1. A heat-developable image-recording material comprising on a support:

a silver-supplying layer comprising an organic silver salt, a reducing agent, an organic binder and photosensitive silver halide in an amount that is 10 wt % or less of a coated amount of photosensitive silver halide in a separate photosensitive layer; and said separate photosensitive layer comprising a photosensitive silver halide and no organic silver salt;

the heat-developable image-recording material further containing an electron-transfer agent.

2. The heat-developable image-recording material according to claim 1 wherein the organic binder is formed from a polymer latex dispersed in an aqueous medium.

3. The heat-developable image-recording material according to claim 2, wherein the reducing agent has been incorporated in the form of microparticles dispersed as a solid in an aqueous medium.

4. The heat-developable image-recording material according to claim 2, wherein the silver-supplying layer contains a halogen precursor.

5. The heat-developable image-recording material according to claim 3, wherein the silver-supplying layer contains a halogen precursor.

6. The heat developable image-recording material according to claim 4, wherein the halogen precursor has been incorporated in the form of microparticles dispersed as a solid in an aqueous medium.

7. The heat-developable image-recording material according to claim 5, wherein the halogen precursor has been incorporated in the form of microparticles dispersed as a solid in an aqueous medium.

8. The heat-developable image-recording material according to claim 1, wherein the electron-transfer agent is a compound selected from the group consisting of hydrazine derivatives, alkene derivatives, isooxazole derivatives and acetal compounds.

9. The heat-developable image-recording material according to claim 2, wherein the electron-transfer agent is a compound selected from the group consisting of hydrazine derivatives, alkene derivatives, isooxazole derivatives and acetal compounds.

10. The heat developable image-recording material according to claim 1, wherein the electron-transfer agent is a hydrazine derivative represented by the general formula below:

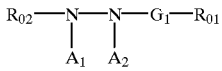

(1)

wherein $R_{02}$ denotes an aliphatic group or an aromatic group, $R_{01}$ denotes hydrogen, alkyl, aryl, an unsaturated heterocyclic group, alkoxy, aryoxy, amino or hydrazino, $G_1$ denotes —CO—, —$SO_2$—, —SO—, —P(O)—, —$R_{03}$P(O)—, —COCO—, thionylcarbony or iminomethylene, and $A_1$ and $A_2$ independently denote hydrogen, or substituted or unsubstituted alkylsulfonyl and $R_{03}$ is chosen from the groups defined for $R_{01}$ and may be the same as or different from $R_{01}$.

11. The heat-developable image-recording material according to claim 2, wherein the electron-transfer agent is a compound selected from the group consisting of substituted alkene derivatives, substituted isoxazole derivatives and acetal compounds represented by the following general formulae (3) to (5)

(3)

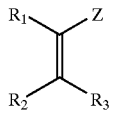

(4)

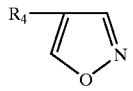

(5)

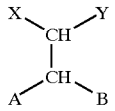

wherein general formula (3) $R_1$, $R_2$ and $R_3$ independently denote hydrogen or a substituent, and Z denotes an electron withdrawing group or a silyl group, in general formula (3), $R_1$ and Z, $R_2$ and $R_3$, $R_1$ and $R_2$, or $R_3$ and Z may be bonded together to form a cyclic structure, in general formula (4), $R_4$ denotes a substituent, in general formula (5), X and Y independently represent hydrogen or a substituent; A and B independently denote alkoxy, alkylthio, alkylamino, aryloxy, arylthio, anilino, heterocyclic oxy, heterocyclic thio or heterocyclic amino, and in general formula (5), X and Y, and A and B may be bonded together to form a cyclic structure.

12. The heat-developable image-recording material according to claim 1, wherein a coated amount of photosensitive silver halide in the silver-supplying layer is 1 wt % or less of a coated amount of photosensitive silver halide in the photosensitive layer.

13. The heat-developable image-recording material according to claim 1, wherein the silver-supplying layer contains no photosensitive silver halide.

14. The heat-developable image recording material of claim 1, wherein the coated amount of the photosensitive silver halide in the separate photosensitive layer is from 0.01 $g/m^2$ to 5.0 $g/m^2$.

* * * * *